US008881839B2

(12) United States Patent
Williams

(10) Patent No.: US 8,881,839 B2
(45) **Date of Patent: *Nov. 11, 2014**

(54) METHODS FOR TREATING "PLUNGE ZONE," HEAVY LIQUID, LARGE TANK, STRUCTURAL IMPEDIMENT AND TIMING ISSUES, WHEN EXTINGUISHING TANK FIRES

(76) Inventor: Dwight P. Williams, Vidor, TX (US)

( * ) Notice: Subject to any disclaimer, the term of this patent is extended or adjusted under 35 U.S.C. 154(b) by 1116 days.

This patent is subject to a terminal disclaimer.

(21) Appl. No.: 11/989,406

(22) PCT Filed: Aug. 2, 2006

(86) PCT No.: PCT/US2006/030070

§ 371 (c)(1),
(2), (4) Date: Jan. 25, 2008

(87) PCT Pub. No.: WO2007/019167

PCT Pub. Date: Feb. 15, 2007

(65) Prior Publication Data

US 2009/0314502 A1 Dec. 24, 2009

Related U.S. Application Data

(63) Continuation of application No. 11/196,882, filed on Aug. 4, 2005, now Pat. No. 8,424,612.

(51) Int. Cl.

| | |
|---|---|
| ***A62C 2/00*** | (2006.01) |
| ***A62C 3/00*** | (2006.01) |
| ***A62C 3/06*** | (2006.01) |

(52) U.S. Cl.

CPC ..... *A62C 3/065* (2013.01)
USPC ..... 169/47; 169/46; 169/66; 169/68

(58) Field of Classification Search

CPC ..... A62C 3/065
USPC ..... 169/46, 47, 66–68
See application file for complete search history.

(56) References Cited

U.S. PATENT DOCUMENTS

| | | | | | |
|---|---|---|---|---|---|
| 1,860,825 | A | * | 5/1932 | Thiede | 169/68 |
| 2,692,649 | A | * | 10/1954 | McCreary | 169/57 |
| 2,936,834 | A | * | 5/1960 | Gomory | 169/44 |
| 3,724,554 | A | * | 4/1973 | Rupert et al. | 169/52 |
| 3,876,010 | A | * | 4/1975 | Blomquist et al. | 169/46 |
| 5,026,735 | A | * | 6/1991 | Stern | 521/50 |
| 5,314,027 | A | * | 5/1994 | Wood | 169/60 |

(Continued)

*Primary Examiner* — Dinh Q Nguyen
(74) *Attorney, Agent, or Firm* — Sue Z. Shaper

(57) ABSTRACT

A method for extinguishing a full, or substantially full, surface liquid tank fire including addressing large tank, difficult fuel, structural impediment, timing and plunge zone issues, the attack including throwing at least one primary stream over a tank wall, the stream landing with a force of impact in, and defining, a plunge zone; the method including potentially achieving flame collapse leaving a plunge zone flame and subsequently, at least for a period of time, diminishing force of impact per unit area of a primary stream upon said plunge zone flame; alternately the method includes achieving a partial flame collapse including collapse against back tank wall portions and subsequently diminishing stream impact force upon a plunge zone including moving a plunge zone forward in the tank; the method also includes extinguishing a full surface heavy liquid tank fire by teasing the fire prior to employing a non-feathered stream to create a foam blanket; the method may include restaging to create a secondary footprint, and/or coordinating the timing of addressing plunge zone, smiley face and secondary footprint issues; the method may also include teasing and/or rooster tailing structural impediments.

12 Claims, 18 Drawing Sheets

(56) References Cited

U.S. PATENT DOCUMENTS 5,411,100 A * 5/1995 Laskaris et al. ..... 169/14
5,829,533 A * 11/1998 Williams ..... 169/46
5,913,366 A * 6/1999 Williams et al. ..... 169/46
2004/0069505 A1 * 4/2004 Griffin ..... 169/46

* cited by examiner

METHODS FOR TREATING "PLUNGE ZONE," HEAVY LIQUID, LARGE TANK, STRUCTURAL IMPEDIMENT AND TIMING ISSUES, WHEN EXTINGUISHING TANK FIRES

This application is a continuation-in-part of co-pending application Ser. No. 11/196,882 filed Aug. 4, 2005 entitled Methods for Treating "Plunge Zone" Issues When Extinguishing Full Surface Liquid Tank Fires, inventor Dwight P. Williams.

FIELD OF THE INVENTION

The field of the invention lies in attacking and extinguishing full surface, or substantially full surface, liquid tank fires, and more particularly in treating "plunge zone" issues as well as heavy liquid, large tank, structural impediment and timing issues, arising from an attack using one or more primary streams thrown over a tank wall.

BACKGROUND OF THE INVENTION

Introduction

The instant invention comprises an expansion of a family of inventions originating with Dwight P. Williams and Williams Fire & Hazard Control, Inc. Familiarity with certain patents and/or patent publications will be presumed for one of ordinary skill in the art. These patents and/or patent publications are: U.S. Pat. No. 5,566,766 (Empirically Determining and Using a FootPrint); U.S. Pat. No. 5,829,533 (Using FootPrint plus External Wall Cooling); U.S. Pat. No. 5,913,366 (Inner Tank Wall Cooling); WO98/03226 (Wall Cooling plus Dry Powder) and US Pub. 20030213602 (Smiley Face Treatment.)

When attacking full surface liquid tank fires in large industrial tanks by throwing foam over the tank wall, the industry has largely switched from a "surround and drown" technique to what has been called a "FootPrint" method. The "FootPrint" method stages one or more primary nozzles roughly together, and preferably upwind of the tank, in what is referred to as a six o'clock position. The nozzle(s) and application rate are selected such that the landing footprint(s) of the foam together with predicted "foam run" will, by design, carry foam to the walls of the tank and create an adequate foam blanket over the surface.

Water from the foam blanket cools; the foam blanket suppresses vaporization; the foam blanket deprives the fire of access to oxygen-combustion usually requires It is accepted in the industry that narrowly focused streams with footprints that maximize the "local application density" of the foam will optimize the creation of a foam blanket.

In attacking and extinguishing full surface liquid tank fires, the instant inventor has determined that two significant "plunge zone" issues can arise. One can arise prior to flame collapse and the other can arise subsequent to flame collapse. Each "plunge zone" issue is usually strongly affected by the nature of the particular liquid burning. The instant invention teaches methodologies for the treatment of these "plunge zone" issues, having at least one objective of at least more cost effectively extinguishing the fire. The instant methodologies might actually be critical to extinguishing the fire, in certain circumstances, or to at least acceptably extinguishing the fire within a predetermined timeframe.

General Points—Notes and Definitions—Memory Refreshing

Industrial liquid storage tanks vary in diameter from about 100 feet to 300 feet or more. The typical wall height is 50 feet. A full surface liquid tank fire for our purposes will be deemed to be a fire involving at least 90% of the liquid surface in a tank. Normally a tank fire prior to any flame collapse would involve 100% of the liquid surface. However, a partially collapsed floating roof or the like might impede fire upon some small portion of the surface. Such a tank fire should yet be treated as full surface fire. A full surface liquid tank fire can be contrasted, for example, with a seal/rim tank fire where a floating roof limits the fire to essentially an annular ring around inside tank wall portions.

"Flame collapse" will be defined herein as the collapse of at least 50% of the flame on the surface of the tank. "Preferred flame collapse" will be deemed to refer to the collapse of at least 80% of the flame on the surface of the tank. "Partial flame collapse" will refer to the collapse of at least 20% of the flame from the surface of the tank. "Substantially full flame collapse" will indicate collapse of at least 95% of the flame on the surface; ghosting or flickering might remain.

A "primary nozzle" is a nozzle used in a primary attack on a full surface liquid tank fire to achieve flame collapse, the nozzle throwing a stream of foam over the tank wall. Primary nozzle flow rates typically vary from 1500 gpm to over 15,000 gpm. As discussed above, one or more primary nozzles are preferably staged roughly together, upwind of a tank, this location being referred to as the six o'clock position, where the combined footprint(s), application rate(s) and foam run are designed to establish and maintain an adequate foam blanket.

Because of the forward velocity of landed foam and the wind, "foam run" is typically the greatest toward the back wall of the tank, i.e. toward the twelve o'clock position. Thus, the wettest and most secure foam blanket is usually created against a back wall. This wet blanket tends to extend around toward the nine o'clock and the three o'clock positions. Flames against inner forward tank wall portions, centered around the six o'clock position, sometimes referred to as "smiley face" flames, tend to be extinguished last. Air tends to be sucked in by the fire over the tank wall at the six o'clock or forward tank wall positions when primary nozzle(s) are staged at six o'clock. This supply of fresh oxygen together with the agitation caused by the inflow of air provides a further reason why flames on inside portions of the forward tank wall may be extinguished last. An additional attack may be waged against such "smiley face" flames to improve performance.

Generally, the farther primary nozzle(s) are stationed from a tank, the better, in terms of lessening the risk of loss of equipment and personnel. Thus, primary nozzles with long ranges and/or primary nozzles adjusted to maximize range may be preferred. A straight, narrowly focused stream from a nozzle is doubly preferred, not only because it maximizes range but also because it maximizes "local application density," which is accepted as optimizing the formation of a foam blanket.

Preferably, a primary nozzle has a capacity to vary its thrown stream from a "fog" or "feathered" pattern to a narrowly focused straight stream or a non-feathered pattern. Preferably also a primary nozzle can be raised and/or lowered, to vary the height or inclination of its trajectory, and can be moved to oscillate or sweep, relatively rapidly, from side to side. A rapid oscillation would be deemed to be a sweep of about a 45 degree angle within at least 30 seconds. Preferably the sweep would take less than 20 seconds. Preferably also a primary nozzle can vary the application rate (gpm) of its thrown foam and can vary the proportioning rate of the foam concentrate. Some primary nozzles do not have all of these capabilities. Efficiency is enhanced when such preferred primary nozzles are available.

The term "foam" is used to refer to water and foam concentrate and/or already formed foam. "Foam," however, is not necessarily limited thereto. More exotic liquids than water and more exotic additives could be developed and applied. "Foam" should be understood, as used herein, to also include just water, for convenience. Thrown "foam," typically however, is water and foam concentrate which expands prior to or upon being thrown and/or at least expands upon landing.

As discussed above, foam extinguishes fire in part by blanketing the liquid surface, cutting off access to air or oxygen. (Oxygen is needed to sustain combustion.) Foam in part also extinguishes fire by means of the water in the foam evaporating, thereby removing heat. (Heat is needed to sustain combustion.) Foam also extinguishes fire by suppressing vaporization. Water carried by the foam helps to weigh the foam down, thus helping to suppress vaporization. (Frequently it is only the vapor upon the surface of a liquid that is burning. In fact, with many tank fires the liquid is cool a few inches below the burning surface. The exception is heavy liquids, such as crude, resid, asphalt and the like.)

Dry foam, foam from which the water has largely evaporated, runs less well and blankets less well. Dry foam has less weight and so it suppresses vaporization less well. Dry foam has less water and so it cools less well. Light, dry, dehydrated foam can even be a hindrance, in that the presence of a bulk of light dry foam can inhibit the approach of fresh hydrated foam. Foam "drain time," thus, is an industry defined term. It is an important parameter that is measured. "Drain time" is the time in which a foam loses 25% of its water. "Drain time" typically runs between 2 and 8 minutes for foam. Foam drain time is taken into account in planning a full surface tank fire attack. It has been discovered, in particular when working with new fuel mixtures, that drain time can be further affected by the liquid in the tank. Hydrophilic fluids drain water out of the foam down into the liquid, thereby prematurely drying out the foam. New fuel mixtures have shown significant hydrophilic tendencies. This effect is further a function of the contact area and thus can render important a minimization of agitation of the underlying liquid by fresh foam.

A "plunge zone" is the landing area of a primary stream upon the liquid surface in the tank. As the stream is moved or altered, the plunge zone is moved or altered. If the stream is broadened sufficiently, the stream is said to be a feathered stream. A feathered or broadened stream has a larger plunge zone than a non-feathered more narrowly focused stream. The impact force per unit area of a narrowly focused stream is greater than the impact force per unit area of a feathered stream, given the same application rate.

Application rate refers to the application rate of "foam" and is usually in gpm. "Local application density" refers to the application rate per unit area of a landing zone. The terms landing area, landing zone, plunge zone, plunge zone area and footprint are sometimes used interchangeably. A narrowly focused stream, for a given application rate, maximizes "local application density." As mentioned above, maximizing "local application density" tends to optimize, it is believed, the overall effectiveness of thrown foam to form a foam blanket and to run.

"Feathering" a nozzle stream is used herein to mean at least decreasing a nozzle stream's local application density. Usually feathering a nozzle stream means increasing the landing area while maintaining the same volumetric flow rate. Feathering could be accomplished, or assisted, by lowering the application rate of the stream.

A nozzle stream landing area (alternately referred to as footprint or plunge zone or plunge zone area) is typically increased by raising the nozzle to achieve a longer higher trajectory and/or by varying the nozzle discharge angle, typically by increasing the angle.

The term "feathered stream" herein, for convenience, will refer to a stream to having a local application density of less than 0.5 gpm per square foot of landing area. A "preferred feathered stream" will have a local application density of 0.3 gpm per square foot of landing area or less. A "non-feathered stream," will be deemed to have a local application density of at least 0.5 gpm per square foot of landing area. As "preferred non-feathered stream" will have a local application density of 0.6 gpm per square foot of landing area or greater.

"Teasing" a full surface liquid tank fire is used herein to refer to landing one or more "feathered streams" over at least 60% of the surface of the fire over a period of no more than one minute.

"Diminishing," as used herein, is intended to include not only reducing but also completely reducing to zero, or stopping. I.e. the force of impact per unit area of a primary stream upon a plunge zone might be "diminished" by redirecting the stream such that there is no longer any impact upon that original plunge zone. The impact force per unit area could also be diminished by feathering the stream such that there continues to be impact upon the original plunge zone but the force of impact is lessened per unit area, such as by spreading the force over a larger or enlarged plunge zone. "Redirecting" can achieve "diminishing" the force of impact per unit area of a primary stream upon an original plunge zone by directing the stream to another portion of the surface or by directing the steam to outside of the tank, as for instance by landing the stream upon outside tank wall portions.

"Healing" in regard to a foam blanket indicates a phenomena where a foam blanket, perhaps together with new foam, spreads over and fills in a hole or a gap in a foam blanket. The hole or gap could be in the middle of the blanket or at the edge of the blanket, such as between a blanket and a portion of a tank wall. "Healing" should be understood to generally accomplish extinguishing any flame in the hole or gap, save and except perhaps for some ghosting or flickering.

The term "heavy liquid" will be used herein to refer to a liquid with a significant amount of heavies. Crude, light crude, resid and asphalt are prime examples. (Heavy liquid as used herein will be understood to include solids at ambient temperature and pressure when they are maintained liquid in industrial storage tanks by the application of heat. For instance, asphalt and resid are normally solids but might be maintained as liquid in an industrial storage tank by the application of heat. They might be heated to 300 degrees or greater.) The identification of a heavy liquid is significant because a full surface tank fire of heavy liquid has been observed to behave distinctly. It is believed that the distinct behavior results in part from a phenomena where the lights burn off while the heavies sink. It is known that a heavy liquid full surface tank fire tends to get hot for depths of between several inches to several feet. Heat waves, as they are referred to in the industry, descend from the surface of a heavy liquid toward the bottom of the tank. The heat wave can descend at a rate of between several inches an hour to several feet an hour. Since tanks with a full surface fire tend to draw air in over a leading or front tank wall portion, in the upward direction, the downwind direction of a full surface heavy liquid fire, as a result, can tend to have the deepest heat waves.

First Plunge Zone Issue—Plunge Zone Flame Subsequent to Flame Collapse

The Problem.

In a typical attack on a full surface liquid industrial tank fire one or more coordinated streams of foam are thrown over the tank wall. The stream(s) initially appear to vanish into the fire with no apparent effect. After 10 to 40 minutes of a well planned attack, however, "flame collapse" occurs. Those of skill in the art can predict flame collapse with close to scientific accuracy.

Significant problems can remain after flame collapse. First, a concerted attack must be continued to extinguish the remaining flames and to prevent re-ignition. To the extent that the foam dries out, it can cease to help and can even inhibit, so time may be of the essence. The hydrophilic nature of the burning liquid can be a factor with respect to effective foam drain time.

Second, foam concentrate is expensive and the burning product may be expensive. (Fuels burn at approximately 6-18 inches per hour, and large tanks provide 30,0000 to 90,000+ square feet of surface area.) Simply minimizing extinguishment time can significantly reduce the costs of the loss, through reducing foam concentrate utilized and product lost, not to mention through reducing total risk to equipment, personnel and the environment. For a variety of reasons, thus, the methodologies adopted after flame collapse can be important.

Flames remaining after "flame collapse" can be a function of variety of factors. Full surface tank fires must be addressed individually. One factor is the nature of the liquid burning. High vapor pressure and/or low boiling point liquids and volatile fuels can present special behavioral issues. Minimizing the contact area of fresh foam with a significantly hydrophilic liquid might be important. Metal tank walls become hot at the burn level upward and liquid adjacent the walls is easily energized, vaporized and combusted. The foam blanket must have sufficient authority to heal over against these hot tank walls. Sacrificing the "local application density" created by narrowly focused primary stream(s) in order to address other issues can risk losing flame collapse.

With the understanding that one should take into account the above factors, the instant invention addresses the first "plunge zone" issue as follows.

The location where the thrown foam stream impacts the liquid surface defines a "plunge zone." In the plunge zone the stream plunges beneath the surface. The depths of the plunge can be a function of the force of impact per unit area, which can be a function of the narrowness and/or the focus of the stream. It has been observed that upon flame collapse, especially with newer and more volatile fuels and mixtures, a "plunge fire" or "plunge flame" can persist in the plunge zone. The impact force of the landing stream, perhaps augmented by the agitation caused by the force of landing, can inhibit a foam blanket from healing over in the plunge zone even though flame collapse is achieved. To the extent the burning liquid is significantly hydrophilic, the agitation from landing foam can increase the liquid's capacity to drain water out of the foam, rendering the new foam more quickly dehydrated, light and dry, and thus less effective to suppress combustion. A combination of factors can result in the situation where, subsequent to flame collapse, there remains a plunge flame for an unacceptably long period of time, possibly, without more, indefinitely.

Solutions.

The plunge flame may go out, of course, with a continued application of narrowly focused stream(s). The foam blanket can build up in the plunge zone notwithstanding the impact forces of a narrowly focused stream such that the "plunge," so it is believed, ceases to reach down into and disturb the underlying liquid. If or when the landing impact becomes largely absorbed by a foam blanket itself, it is believed that the blanket tends to heal over and the plunge flame becomes extinguished.

However, especially with the newer and more volatile fuel mixtures, a plunge flame can remain a significantly and unacceptably long period of time after flame collapse, even after achieving substantially full flame collapse, absent use of the more specialized techniques taught herein. The instant invention teaches specialized techniques and methodology for more effectively addressing such plunge flames. (And as an alternate although less favored embodiment, the invention teaches a technique for anticipating a plunge flame issue and adopting a strategy to lessen the risk of the plunge flame problem arising.)

Again, the timing of the application of the methodology of the instant invention requires a fact and circumstances risk assessment. Diminishing the impact forces from the application of foam to a plunge zone, such as by feathering a stream or redirecting the stream or cutting off the stream and/or reducing application rate, reduces local application density. Flame collapse can be lost. That risk is not to be taken lightly, and caution and prudence suggest something like an initial rule of thumb of maximizing foam run for, say, ten minutes after foam collapse, which period should include the time needed for extinguishing any smiley face. Preferably, the only other flames remaining when turning to address a plunge flame would be some ghosting or flickering of flames along tank walls. A sufficient foam blanket around a plunge flame preferably exists such that a foam blanket can quickly move into and heal a plunge flame zone upon the diminishing of stream impact forces per unit area on the plunge flame. If choosing to diminish impact forces by redirecting the plunge zone to a different area in the tank, such as moving the zone laterally, care should be taken not to start a new plunge fire in the new plunge zone(s), such as might occur by moving the plunge zone closer to some remaining fire in the tank.

Second Plunge Zone Issue Addressed—Initial Plunge Zone Behavior (Heavy Liquid)

Problem.

Observation and experience has taught the instant inventor that a fully engaged tank fire of a heavy liquid becomes violent and unruly when first hit with a narrowly focused stream of foam. In the usual case, by the time nozzles are staged and an attack is initiated, the heavy liquid of a fully engaged tank fire is very hot, over the boiling point of water, down several inches if not several feet below the surface. Indeed, heavy liquid such as asphalt and resid may have been maintained at 300 degrees or higher simply to keep the substances liquid in the tank. Until the surface temperature comes significantly down with respect to the boiling point of water, a foam blanket will have difficulty being established or maintained. The heat boils the water out of the bubbles, and the plunge force per unit area of a narrow focused stream tends to create a splatter effect, splashing burning liquid out of the tank. Further, a significant percent of the water thrown with a narrow stream plunges through the liquid surface. The water from the foam that plunges deep can boil beneath the surface, causing further agitation of the burning liquid.

Solutions.

It has been found that in a full surface heavy liquid tank fire, such as crude, resid and asphalt, prior to a customary application of a focused stream of foam, designed to maximize local application density and optimize foam blanket formation, it is advisable, indeed it may be imperative, to create a different "plunge zone." An initial "plunge zone" should be designed and created to minimize forces of impact per unit area and to maximize the removal heat from a broad portion of the surface of the fire, via water turning to steam. Application rates and local application density needed for creating and maintaining a foam blanket can be sacrificed during this period. The instant invention teaches initially "teasing" the fire with a stream or streams that have a wide plunge zone and a low local application density, typically including sweeping the wide plunge zone(s) back and forth to cover a significant percent of the burning surface. Streams that lessen the impact force per unit area lessen the plunge depth and the boiling effects created by plunge depth. It is preferable to continue teasing for a few minutes, or possibly until a partial flame collapse is achieved, in order to take the heat and anger out of the fire and to lessen the temperature of the burning surface, such that a foam blanket can subsequently be more readily established. A broad feathered landing pattern is preferably utilized at this stage, oscillating the pattern relatively rapidly across the burning surface, from left wall to right wall and back again, to cover as much of the surface as possible. The feathered stream may sweep or oscillate completely off of the burning surface for a second or two. The application rate of this feathered stream can be less than the required application rate for establishing a foam blanket, and one may reduce or eliminate the amount of foam concentrate involved.

It has been found that two to four minutes of such initial "teasing" of a 150-foot full surface crude tank fire can significantly "steam away" the intensity or anger of the fire. A significant amount of the water from the feathered stream turns into steam at the surface, not only taking heat from the fire but also blanketing the surface with steam, thereby, it is believed, inhibiting access to air. As mentioned above, a partial flame collapse can occur as a result of this initial teasing. Again, as discussed above, during this teasing period the application rate of the stream(s) can be lowered and the percent of foam concentrate proportioned into the foam can be lowered or eliminated. Subsequently, the customary narrowly focused stream(s) that maximize local application density to optimize the establishment of a foam blanket can be applied with greater effect.

Large Tank Issue—Restaging for Secondary FootPrint

Tank size has significantly increased with time. Today a 200' diameter tank is a "medium" tank. A 270' diameter tank is a "large" tank. Over 400' diameter tanks are being constructed and put into service. (This size can only be referred to as "huge.")

A throwing range of 400 feet can be taken as a typical maximum range for a large well focused and well constructed nozzles in general. Ranges of closer to 500 feet can be achieved today with some nozzles. Large nozzles, especially those throwing foam 400 feet or greater, impart a significant forward velocity to the foam upon impact. The nozzles are generally staged upwind and the wind imparts a further forward or downwind velocity to the foam, toward the tank back wall. Fresh foam tends to run, thus, first toward back tank wall portions. From there it spreads left and right and back toward the middle of the tank. New foam bounces off of, or reflects backward from, older foam, reflecting toward the forward, front tank wall portions. The older foam acts as a "new wall," in effect reflecting the new foam back toward the front.

Table II indicates typical footprints of nozzles characterized by their application rate or gallons per minute (gpm.) Although maximum theoretical foam run today is about 100', the instant inventor advises only relying in practice upon achieving about 80% of maximum theoretical foam run. This would be about 80'. (It is further advisable only to rely on achieving about 75% of the maximum theoretical foam run, or about 75', in the direction of the front tank wall.)

Reviewing Table II together with the above information, it can be seen that a footprint from a 10,000 gpm nozzle, thus, should only preferably be relied upon to cover a 150'+80'+75', or 305,' diameter tank. (Multitude footprints are staged side by side to cover, together with foam run, a tank's lateral width.)

Many times large size nozzles are not available. Thus, for large and especially for extra large tanks the instant inventor teaches herein a "secondary staging technique." Nozzles are preferably staged first such that the initial footprint (or footprint set) insures that foam run reliably reaches the back wall. After a suitable period of time, which may be 12 to 15 minutes, the inclination angle of one or more nozzles can be lowered. This moves one or more footprint(s) forward in the tank, toward front wall portions of the tank. One or more footprints are moved to a "secondary" staging position, preferably within 75' of front tank wall portions. This secondary staging technique facilitates foam run reaching front tank wall portions. In some cases the secondary staging might be imperative. If a "smiley face" is created, react lines may be effectively employed against the "smiley face," to insure efficiency.

The instant inventor teaches recommended application rates for hydrocarbon storage tanks as a function of tank diameter. See Table I. The recommended application rate for tanks up to 150' is a standard 0.16 gpm per square feet. As tank diameter size increases the instant inventor's recommended application rate increases. These recommended application rates have been developed by experience and testing over time. They are not hard and fact rules but rather approximate targeted rates.

To illustrate how Table I can be used, a 200' diameter tank has approximately 31,400 square feet of surface area. Multiplying 31,400×0.18 yields an approximately 5,650 "recommended" gpm. A 300' diameter tank would have a surface area of approximately 70,650 square feet. Multiplying 70,650 square feet×a 0.25 application rate yields a "recommended" application rate of 17,660 gpm. In the case of the 200' tank, a 6,000 gpm nozzle could arguably blanket the surface without secondary staging. In the case of a 300' tank, three 6,000 gpm nozzles might be utilized to achieve the recommended application rate. Foam run from an initial footprint for these three nozzles, however, should not be relied upon to run both to back wall portions and front wall portions (as well as to both sides) in a timely manner. Thus, an initial footprint (set) from an initial staging of the nozzles best ensures that foam run from the initial footprint (set) reaches back tank wall portions. Subsequently, the technique of lowering the nozzles' inclination angle can achieve a secondary staging and footprint (set) where foam run should rebound off of older foam to reliably reach front wall portions. (As foam builds up against back wall portions the foam itself forms a "wall" that reflects fresh foam back toward front wall portions.)

So to summarize the large tank problem and solution, given the growing size of modern tanks and the limited extent of adequate reliable foam run, foam from an initial footprint staging may not be relied upon to timely and adequately reach front tank wall portions. Thus, staging a secondary footprint (set) more forward in the tank, preferably within 12 to 15 minutes of commencing the foam attack, and preferably by lowering the inclination angle of at least some nozzles used in establishing the initial footprint (set), can effectively address the problem.

Timing the Steps in the Attack Issue

An initial adequate foam blanket may be defined as at least 3" of foam and preferably at least 5" of foam. As a general rule, 0.62 gallons of liquid water/foam concentrate yields one inch of "liquid" over a square foot of surface. If the expansion rate of the water/foam concentrate is 3 to 5, then one inch of "liquid" should yield three inches to five inches of foam over the square foot. Preferably, an initially adequate blanket is created in at least 30 minutes from commencing the foam attack, and most preferably within 15 minutes. (By 40 minutes from commencing a foam attack, given foam drain time, significant amounts of foam are likely to be dried out. Dried foam, as discussed above, can be a significant hindrance to completing a foam blanket and to creating an adequate foam blanket. Drain time of the foam, thus, makes timing critical, in light of the above, since dried out foam can form ridges, so called "plastic fences," inhibiting the movement of fresh foam.)

Timing of the steps in a well thought-out attack, thus, can be critical. Possible steps in a well thought-out attack may include:

(1) as disclosed in co-pending application published as US publication 2003/0213602, directly addressing a remaining "smiley face" with secondary react lines to facilitate (or speed) foam run reaching front tank wall portions;

(2) utilizing a technique to extinguish plunge zone flame, discussed above, especially with the more volatile fuels which enhance plunge zone issues, in order to allow a foam blanket (at least expeditiously) to heal over all remaining fire;

(3) given a large tank size, treating with secondary footprint staging.

The problem of securing an adequate foam blanket is preferably solved within no more than 40 minutes from commencing the attack, due to the tendency of foam to dry out and to begin to hinder rather than help. Thus, for attacks on fires in large tanks, especially involving difficult fuels, it is important to properly time various steps in a well thought-out attack. E.g. re-staging for a secondary footprint should preferably be carried out within 15 minutes of commencing the attack. Attacking a smiley face with react lines, if it is to be attempted, should be carried out within 30 minutes of commencing the primary attack. Diminishing application rate density (e.g. plunge zone attacks) should be carried out within 40 minutes of commencing the attack.

Burn Off and Start Over—A Timing Technique

The instant inventor also teaches that burning off and starting over should never be totally discounted as an option during a fire. The newer fuels typically stored today in tanks, fuels with a greater content of alcohols and/or polar solvents, can be far more difficult to extinguish. The availability of concentrate at the best percent for the fuel can also be a significant factor. What first appeared to have been an optimum foam concentrate for a particular hydrocarbon fire may turn out not to have been the best. A plunge zone flame might not have been detected and addressed in a timely fashion. When an attack has been commenced and proven inadequate, for any of a variety of reasons, sections or segments of a dried foam blanket can inhibit the effectiveness of a more appropriate attack. Burning off and starting over, thus, should be considered a viable option. Burning off old dried foam should take approximately 20 minutes. Most hydrocarbons burn only approximately 6 to 12 inches an hour. Burning off and starting over, thus, permits a fresh approach with more optimum equipment and techniques and timing, with methodologies better designed for the particular fire, as learned through a prior unsuccessful attempt, without undue sacrifice of product.

One technique, thus, if things are not going well after 1½ to 2 hours into an attack, may be to cease applying foam to the fire for at least 10 minutes in order to let existing foam largely burn off, then commence a more advantageous attack. Twenty minutes of burn off may be necessary or preferable. One might be well advised to burn off the old foam and start over, perhaps even with a different foam concentrate. Since in approximately 20 minutes dried foam should burn off from a tank surface and the hydrocarbon product in the tank should only be burning at a rate of 6 to 12 inches per hour, burning off and starting over may be the cost effective approach if, now enjoying hindsight, a more effective strategy could be implemented.

Structural Impediment Issue—Use of Non-Narrowly Focused Stream

A "substantially full surface" liquid tank fire will be deemed herein to be a fire covering at least 60% of the interior tank surface. A "substantially full surface" tank fire is more than a seal/rim fire. It may, however, involve significant structure interfacing with the liquid surface. This structure can significantly inhibit foam run and the forming of a foam blanket and can support "pressure type" fires or hot spot fires. In cases, thus, where collapsed or partially collapsed fixed roofs and/or floating roofs cause significant interruption of the liquid surface, and provide significant interrupting and impeding structure to foam run or to foam communication, special methodology can be called for. This situation can call for a selected use of "non-narrowly focused" streams and "rooster tailing."

Increasing the height or inclination angle of a nozzle tends to create a feathered stream, which is perhaps more accurately described as a "non-narrowly focused" stream, as defined below. The term "rooster tail" stream is used herein to refer to a stream from a nozzle with a sufficiently high inclination angle that the landing path of the stream is "substantially vertical." By "substantially vertical" the landing path should be no more than 30° from vertical and preferably no more than 20° from vertical. "Rooster tailing" refers to applying a rooster tail stream.

As fire fighting nozzles improve, higher application rate densities are achievable. Nozzle development creates a capacity to throw narrower and tighter footprints. One way to distinguish "non-feathered streams" and "feathered streams," in light of this trend, is to talk in terms of "narrowly focused" streams and "non-narrowly focused" streams. To begin, a "most narrowly focused" stream will indicate herein achieving a nozzle's highest "local application rate density." It may be referred to as generating the nozzle's "best" footprint. (This footprint is "best" in the sense that the most narrowly focused stream best survives the updraft forces of the fire and achieves the best delivery of foam for maximizing local application rate density.)

(It should be appreciated that, as is known in the art, some foam is always lost to "fallout" in route to a tank, and the edges of a landing footprint are fuzzily defined. The footprint of a nozzle, therefore, as the term is understood in the industry, generally refers to the landing area of approximately 80% of the stream of foam initially thrown.)

The "most narrowly focused" or "best" stream refers to the stream that lands the smallest footprint for that nozzle (in the circumstances,) the stream that ends 80% of the foam with the highest local application rate density. The term "narrowly focused" stream (for a given nozzle and circumstances), for our purpose herein, will be a stream that achieves a footprint of no more than 1.5 times the size of the nozzle's "best" footprint. A "non-narrowly focused" stream (for a given nozzle and supply circumstances) for our purposes herein will be defined as a stream that achieves a footprint of at least 1.5 times the "best" footprint, or greater. The application rate density of a "non-narrowly focused" stream, should be no more than ⅔ of the application rate density of the "most narrowly focused" stream (for a given nozzle in given circumstances.) Preferably it would be not be more than ½.

Petrochemical storage tanks frequently have an exterior fixed top roof and an interior floating roof, referred to as a floater. The floating roof floats on top of the liquid and typically has seals that sweep along and seal against the interior walls of the tank. When there is a fire in a tank with a floater, the floater is frequently distorted or dislodged. As a result the floater can become partially or totally submerged. The floater can sink to the bottom, in part or in whole. This can happen initially or during the process of a fire. It can happen while product is being pulled out of the bottom of the tank. A fixed and/or top roof can also became distorted and/or dislodged in a fire. It can be blown off or it can collapse within the tank, in part or in whole. If it collapses within the tank, it can break up and become partially or totally submerged, in whole or in part. As a result of the dislodging of a floater and/or a top roof, the surface of the liquid can be significantly affected. By intersecting and interrupting the surface of the liquid, the dislodged floater and/or fixed roof and/or structure associated therewith can significantly impede the run or communication of foam Other tank structures or substructures are, or can become, submerged or partially submerged within a burning tank. Such structures include a gauging well, for instance. Partially submerged pipe, in particular from a gauging well or as used as beams or supports for a floater or a fixed roof, can form the source of localized "pressure-type" fires or hot spot fires. When fire on the liquid surface is significantly extinguished, partially submerged pipes or the like, due to heat and conversion of product to gas and vapor, can continue to support localized fires (where the gas or vapor is vented to the atmosphere.)

Experience recently gained in two independent gasoline tank fires having fixed roofs and interior floaters, which substantially collapsed and submerged within the tank, indicates that partially submerged pipes from the original structures of the tank can support localized "pressure-type" fires.

It was found in each of the two fires above that an initial attack, including application of foam in a concerted steam in a "best" footprint, an attack that should have created a foam blanket over the surface of the tank within 15 minutes, and brought flame collapse, did not in fact result in flame collapse. Structural impediments to movement and communication of foam on the surface of the liquid appeared to inhibit the forming of a full foam blanket. Further, submerged structures supported "pressure-type" fires. In these two circumstances, a methodology of first throwing a narrowly focused stream designed to blanket the surface with foam, followed by attacking and/or teasing the surface with a non-narrowly focused stream, and also rooster tailing, did achieve flame collapse.

The "pressure-type" fires associated with submerged structure, such as pipes feeding a hot fire at their intersection with the atmosphere, were extinguished by rooster tailing. Rooster tailing a stream on an at least partially submerged structure within the tank sent foam down its chimney, so to speak. The rooster tailing was achieved by raising the inclination angle of the primary nozzles from an inclination appropriate to throw a "narrowly focused" stream to a much more vertical inclination, yielding an arcing, rooster tail trajectory and a "non-narrowly focused" stream. The more vertical arcing rooster tail trajectory tended to land foam essentially vertically onto and into not only partially submerged pipe structures but also pockets and holes created by surface structure where foam from the blanket was not able to communicate.

SUMMARY OF THE INVENTION

The invention includes methods for extinguishing a full surface liquid tank fire comprising throwing at least one non-feathered primary stream over a tank wall, the stream landing with a force of impact in, and defining, a plunge zone; achieving flame collapse leaving a plunge flame in a plunge zone; and subsequent to flame collapse, diminishing the force of impact per unit area of a stream upon the plunge flame to that of a feathered stream or less, such that a foam blanket heals the plunge zone.

It is preferable to achieve preferred flame collapse before diminishing stream impact force per unit area upon a plunge flame and more preferable to substantially extinguish flames against inner tank wall portions, except for ghosting and flickering, prior to diminishing stream impact force per unit area on a plunge flame.

A preferred method for diminishing the force of impact per unit area of a primary stream includes enlarging a stream cross section, as by enlarging its discharge angle and/or by raising the nozzle throwing the primary stream. Further methods for diminishing stream impact force per unit area include reducing a nozzle application rate, cutting off a stream, such as at the nozzle, and/or by redirecting a stream, including to outside of the tank such as to against outside wall portions of a tank, for a period of time. Another method for diminishing a force of impact of a stream on a plunge flame includes moving the plunge zone of the stream within the tank, such as laterally.

As an alternate embodiment, partial flame collapse could be achieved, including flame collapse against back tank wall portions, followed by diminishing stream impact forces per unit area upon an initial plunge zone while moving a stream plunge zone forward in the tank, thereby extinguishing plunge zone flame prior to substantially full flame collapse.

The invention includes a method for extinguishing a full surface heavy liquid tank fire, the method comprising teasing the fire for at least a minute with a feathered stream followed by applying a non-feathered stream of foam designed for substantially blanketing the surface with foam. Preferably the fire would be teased for between 2-4 minutes or until a partial flame collapse occurred. Teasing preferably includes oscillating a feathered stream such that the feathered stream landing area oscillates or sweeps from a 3 o'clock to a 9 o'clock position, or vice versa. Preferably an oscillation or sweep can be performed within 20 seconds. The stream may be briefly swept off of the burning surface of the heavy liquid.

The invention also includes restaging a secondary footprint. This is a method for extinguishing an at least substantially full surface industrial scale hydrocarbon tank fire by applying an effective gpm of foam with one or more nozzles staged exterior to and generally upwind of the tank, creating thereby with one or more primary footprints landing at least at or within 80% of theoretical foam fin from a downwind back tank wall portion. Subsequently the methodology includes restaging one or more nozzles to create one or more footprints landing at or within 75% of theoretical foam run from an upwind tank portion. (More preferably the secondary footprint would land within 60% of theoretical foam run from an upwind front tank wall portion.) Further, preferably, the restaging includes lowering the angle of inclination of one or more the nozzles throwing the primary footprint. Preferably the restaging is within 15 minutes of commencing the applying of the primary footprint and more preferably, within 12 minutes.

Preferred embodiments of the invention also include the relative timing of restaging footprints, smiley face attacks and diminishing impact on a plunge zone. The invention includes a method for extinguishing an at least substantially fall surface industrial scale hydrocarbon tank fire that includes applying approximately a gpm of foam computed from Table I with one or more nozzles staged exterior to and generally upwind of the tank, creating thereby one or more primary footprints landing at or within 80% of theoretical foam run from a downwind back tank wall portion. The methodology also includes, subsequently, performing at least one of the steps of restaging one or more nozzles to create a footprint more forward in the tank within at least 15 minutes of commencing the applying; attacking a smiley face with one or more react nozzles within at least 30 minutes of commencing the applying; and diminishing application rate density on a plunge zone within at least 40 minutes of commencing the applying.

The invention also includes methodology for burning off and starting over, the methodology including applying foam to a fire for at least 90 minutes without achieving substantially full flame collapse, then ceasing to apply foam to the fire for at least 10 minutes, and then re-applying at least approximately a gpm of foam computed from Table I.

The instant invention includes addressing tank fire surfaces having structural impediments. Such comprises a methodology for extinguishing an at least substantially full surface industrial scale hydrocarbon fire having substantial structural impediments over an interior surface. Steps include throwing a non-feathered stream to the interior surface of the tank, designed to blanket the surface, and subsequently teasing the interior surface with a feathered stream. Alternately the methodology includes throwing a narrowly focused stream on the surface, designed to blanket the interior surface of the tank with foam, and subsequent to flame collapse, attacking pockets of fire on the interior surface with a non-narrowly focused stream. The methodology may also include rooster tailing an at least partially submerged structure within the tank subsequent to at least partial flame collapse.

BRIEF DESCRIPTION OF THE DRAWINGS

A better understanding of the present invention can be obtained when the following detailed description of the preferred embodiments are considered in conjunction with the following drawings, in which.

The drawings are primarily illustrative. It would be understood that structure may have been simplified and details omitted in order to convey certain aspects of the invention. Scale may be sacrificed to clarity.

DESCRIPTION OF THE PREFERRED EMBODIMENTS (Preliminary Notes: Subsequently as used in the claims means "at least subsequently," not "only subsequently." Dry powder, to the extent available, can be used to enhance the extinguishment of any tank fire, including plunge flame issues. The problem with dry powder is the limited extent to which one can rely on its timely and adequate availability. Thus, the use of dry powder is not addressed herein. That is, no reliance is placed on the availability of dry powder.)

Figure 1:
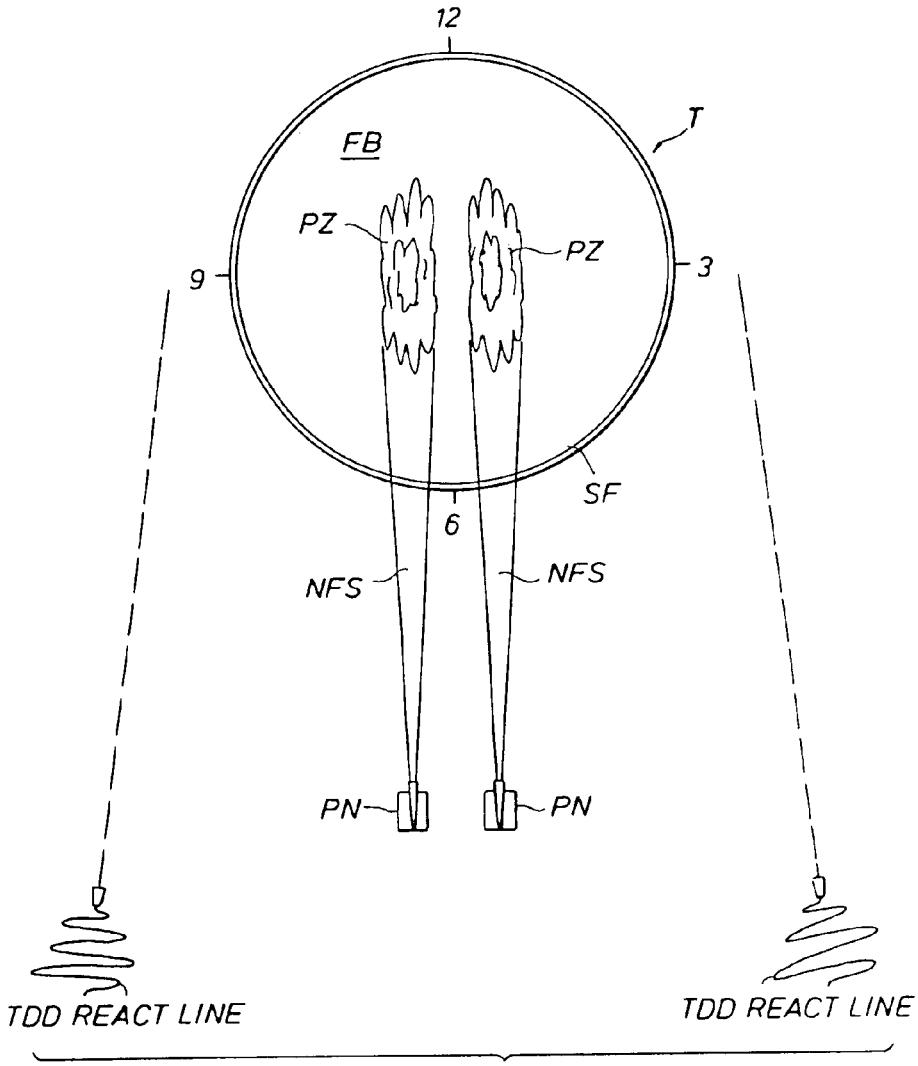
FIG. 1 illustrates an industrial storage tank haying a foam blanket established over much of the surface, a plunge zone defined by two primary nozzles and a smiley face flame remaining.

FIG. 1 illustrates a petroleum storage tank T in which a foam blanket FB has been established on the surface of what had been a full surface liquid tank fire. Smiley face flames SF remain on the inside of front tank wall portions, generally in the six o'clock position and extending from the three o'clock to the nine o'clock position. Two primary nozzles PN have been staged at the general six o'clock position. They throw non-feathered streams NFS onto the surface of the liquid in tank T, landing in and defining plunge zones PZ. Foam run from the primary nozzles has created foam blanket FB.

Figure 2:
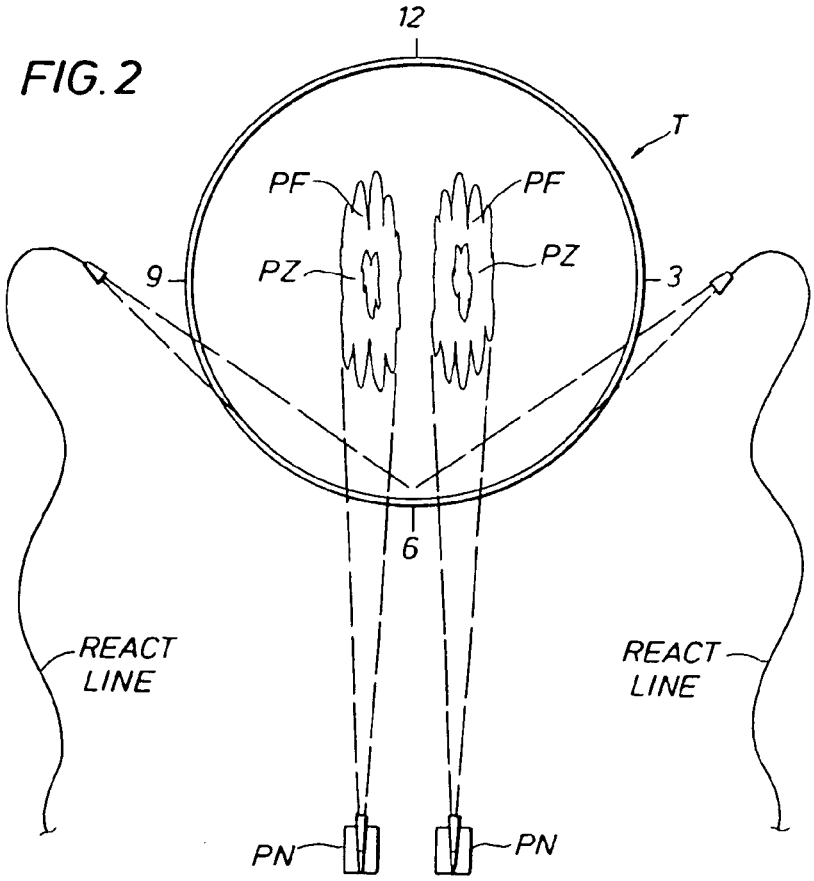
FIG. 2 illustrates extinguishment of the smiley face of FIG. 1 with a plunge flame remaining in the plunge zone.

Tank T of FIG. 1 exhibits flame collapse. In a preferred methodology react lines would be staged relatively quickly after flame collapse to attack the smiley face flames. The react lines are preferably staged at the three o'clock and the nine o'clock position. FIG. 2 illustrates two react lines deployed as above, addressing the fire in the generally three to nine o'clock position against front wall portions of the tank, thereby extinguishing the smiley face flames. FIG. 2 illustrates, however, that a plunge flame PF remains in primary nozzle plunge zones PZ.

Figure 3:
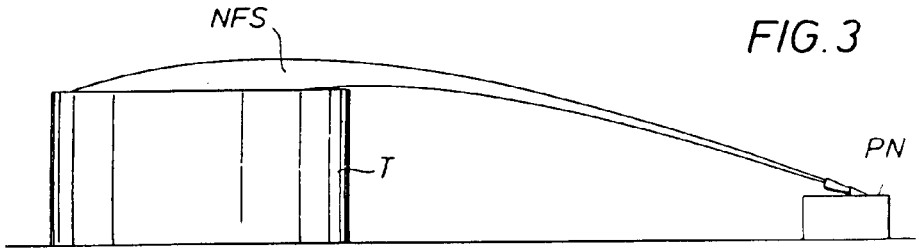
FIG. 3 illustrates a relatively straight narrowly focused stream that maximizes local application density, the approach typically utilized to optimize the creation of a foam blanket.

In a side view FIG. 3 illustrates a primary nozzle PN throwing a relatively narrowly focused non-feathered stream NFS onto the liquid surface of tank T.

Figure 4:
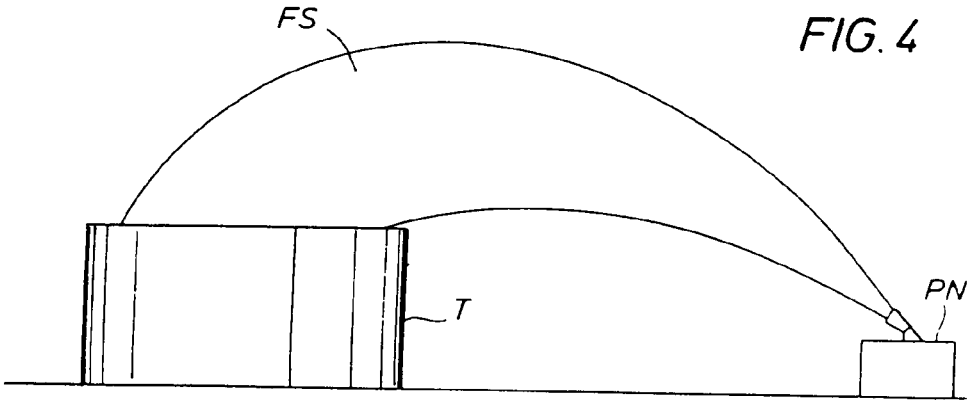
FIG. 4 illustrates a feathered stream that can be utilized to diminish impact forces per unit area.

FIG. 4, by contrast, illustrates primary nozzle PN throwing a feathered stream FS onto the liquid surface of tank T. The stream has been feathered in FIG. 4 by raising the nozzle and by changing the throwing pattern from a narrowly focused pattern to closer to a "power-cone." The feathered foam pattern tends to minimize impact forces per unit area from the stream and thus tends to minimize the plunging of the foam into and through the flammable liquid surface. In determining to switch from a narrowly focused stream of FIG. 3 to a feathered stream of FIG. 4, the operator must decide in the circumstances when and for how long to feather a stream in order to adopt a plunge flame attack plan. Many factors should be taken into account, including in particular the exact nature of the liquid burning. Although not necessary, it is preferable to extinguish smiley face flames prior to attacking plunge zone flames.

Figure 6:
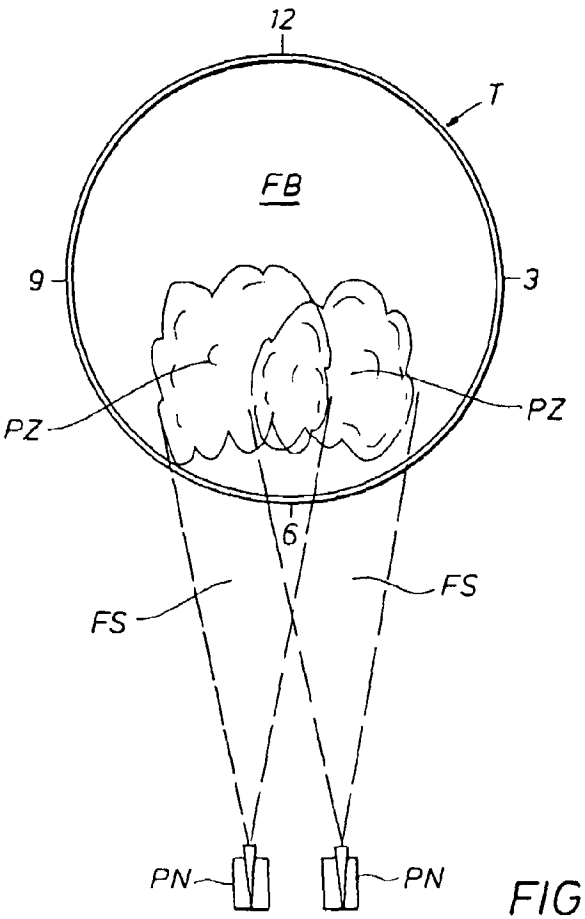
FIG. 6 illustrates a movement forward in a tank of the plunge zones of the two nozzles in FIG. 5, the foam blanket now covering the tank surface.
Figure 5:
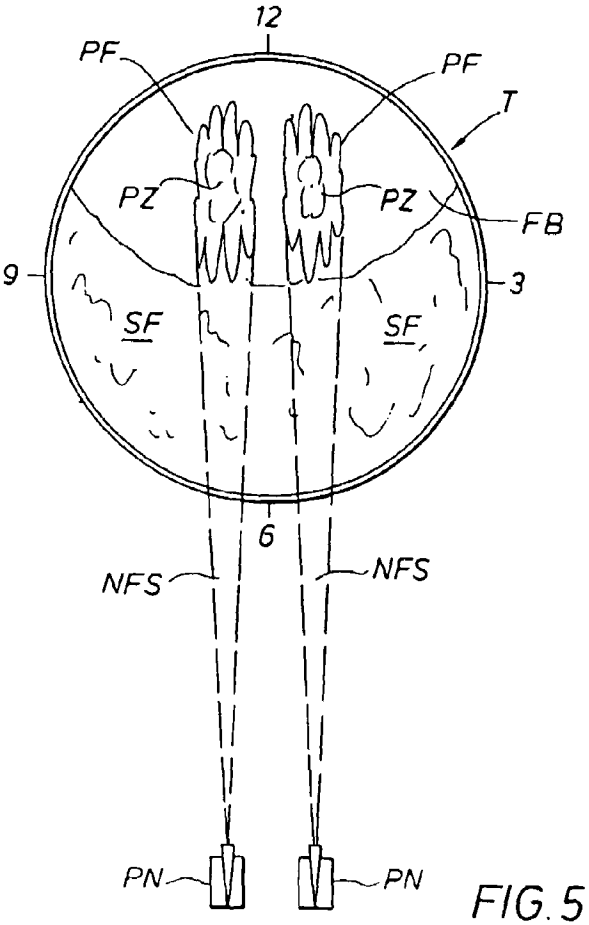
FIG. 5 illustrates a partial flame collapse with two non-focused streams and a foam blanket established against back wall portions.

FIG. 5 illustrates an alternate embodiment where two primary nozzles PN are throwing non-feathered narrowly focused streams NFS landing toward the back of tank T and creating a substantial foam blanket FB initially against back wall portions. Significant flames and/or smiley face flames SF exist in front half portions of the tank. Plunge flame PF can exist in the two plunge zones PZ. FIG. 6 illustrates a subsequent period to that of FIG. 5 where the two primary nozzles PN have changed their pattern to create more feathered streams FS, the plunge zones PZ having become larger and the plunge zones having moved toward the front of the tank. Foam blanket FB now continues to exist over back portions of the tank but also has filled in over the front portions of the tank as well. Furthermore, the prior existing plunge flame PF in the original plunge zones PZ of FIG. 5 has been healed over by foam blanket FB. Plunge flame in the plunge zones PZ of FIG. 6 have been avoided or healed over also due in part to the lessened force of impact per unit area of the more feathered streams FS in FIG. 6.

In operation, one preferred method for extinguishing a full surface liquid tank fire involves throwing at least one non-feathered primary stream over the tank wall. Preferably this non-feathered primary stream is a narrowly focused stream of foam that maximizes local application density. Whether one or more streams is required depends upon the surface area of the tank and the size or capacity of the nozzles available. The attack that includes throwing at least one non-feathered primary stream over the tank wall is an attack designed to cost effectively and efficiently blanket the burning surface with foam. The stream or streams land with a force of impact in, and define, a plunge zone. Likely, at least for a period of time, there will be a plunge flame in the plunge zone. In many cases, especially with newer fuels, flame collapse will be achieved while a plunge flame remains in the plunge zone. Subsequent to at least flame collapse, if not preferred flame collapse or substantially full flame collapse, the force of impact per unit area of at least one stream upon a plunge flame will be diminished. The diminishing can be managed by different techniques. Especially if substantially full flame collapse has been achieved, including collapse of any smiley face flame, the diminishing might preferably take the form of redirecting the landing zones or footprints of the streams laterally to the side of the tank. In such manner the full application rate of foam can continue to land on the tank surface with local application density maximized. The landing of the narrowly focused streams toward a side tank wall will tend to have a possibly beneficial effect of rotating an existing foam blanket in a tank. Another manner of diminishing the force of impact per unit area of at least one stream is to feather the stream. Feathering a stream has the additional benefit of continuing to add fresh foam to the plunge zone and to the plunge flame, just with diminished impact per unit area.

Preferably the diminishing maneuver is not begun until an adequate foam blanket has been built up around the plunge zone and plunge flame. Thus, even if the force of impact is diminished by redirecting one or more streams, an adequate foam blanket exists to heal over the plunge zone and extinguish the plunge flame, once the intense agitation of the plunge zone is lessened. Redirecting one or more streams off of the surface of the burning liquid in the tank to front wall portions of the tank has the added benefit of at least cooling outside tank wall portions.

Experiments have shown that cutting off all streams, at the nozzle, can be successful in allowing an existing foam blanket to heal over a plunge zone and extinguish a plunge flame.

A conceivable, but less favored embodiment, would diminish stream impact force per unit area by creating a foam that lands lighter. This could involve creating a foam with bigger bubbles and/or with greater expansion, and it might involve switching foam concentrates to a foam concentrate that created larger bubbles and/or had a greater expansion.

A further possible but less favored embodiment involves throwing initially at least one primary stream of foam over the tank wall and landing it in a plunge zone toward back wall portions of the tank. A partial flame collapse is first achieved against back tank wall portions. At that point the invention teaches diminishing stream impact force per unit area upon the initial plunge zone while moving a plunge zone forward in the tank. The initial plunge zone can heal over with the foam blanket formed against back tank wall portions. The plunge zone moved forward in the tank might continue to maximize local application density or might be a more feathered stream. Either way, the objective is to achieve substantially full flame collapse wherein plunge zone flames have also been extinguished. This methodology could involve a separate attack on smiley face flames, or not. A plunge zone, as it moves forward in the tank, towards the six o'clock position, would land upon pre-established foam to some extent.

Figure 7:
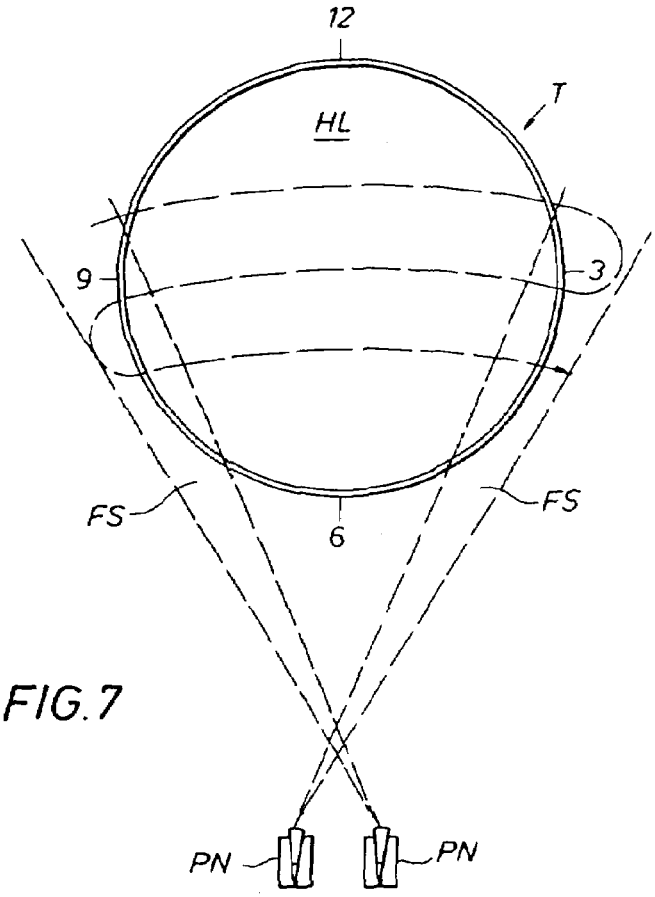
FIG. 7 illustrates the application of an oscillating feathered stream to a tank surface, the tank surface presumably involved in a full surface heavy liquid fire.
Figure 8:
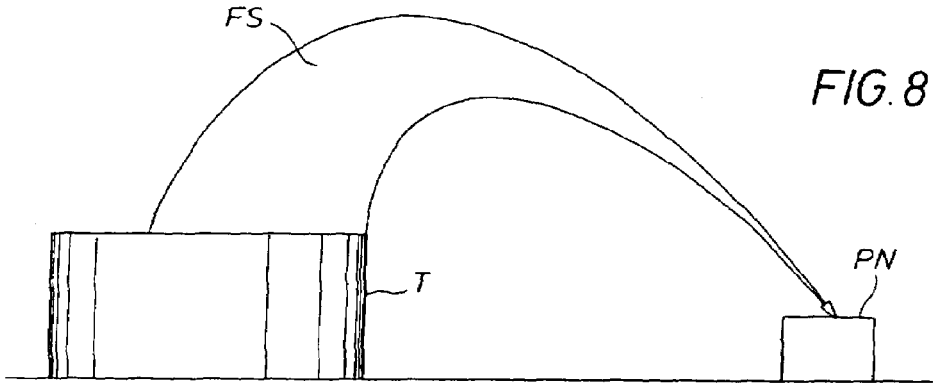
FIG. 8 illustrates a side view of the application of a wide power cone stream to the tank of FIG. 7.

FIG. 7 illustrates tank T enclosing within it heavy liquid HL. One should imagine that tank T involves a full surface fire. FIG. 7 illustrates a method of oscillating a feathered stream FS from one of two primary nozzles PN. FIG. 7 illustrates oscillating feathered stream FS to the right and back to the left and back to the right. Stream FS is oscillated off of the left and right walls of the tank momentarily. A preferred oscillation takes less than 20 seconds. If two primary nozzles will be staged to achieve the application rate necessary for establishing and maintaining a foam blanket, for the initial teasing of a full surface heavy liquid fire preferably only one nozzle would be used. Furthermore, if the nozzle application rate were 10,000 gpm, the nozzle might be cut back to 5000 gpm for the teasing operation. FIG. 8 illustrates a typical trajectory of a feathered stream as utilized in FIG. 7, the feathered stream being a wide power cone stream achieved largely by raising the trajectory of the stream from the nozzle such that the stream lands lightly. What is not illustrated in FIG. 8, but which those of skill in the art would appreciate, is that with a feathered stream there may be significant fall out of water and/or foam in the area between primary nozzle PN and tank T. Hence, with feathered streams a greater percent of the thrown liquid may not reach the tank.

The function of teasing is to take the heat or the "anger" out of the surface of the fire. The objective is not for the water of the thrown stream to sink below the surface of the burning heavy liquid but rather for the water of the thrown stream to turn into steam at the surface of the burning heavy liquid. The depth of the plunge should be minimized. The focus of teasing is cooling the surface of the liquid. It would be permissible to reduce or eliminate the foam concentrate during the teasing. Even during the teasing some product may be expelled out of the tank. The feathered stream used for teasing is preferably somewhere in between a straight stream, having an approximately zero degree divergence, and a "power cone," having an approximate 30 degree divergence angle.

In operation, the method for extinguishing a full surface heavy liquid tank fire includes, in at least one preferred embodiment, teasing the fire prior to applying a non-feathered stream of foam to the surface for substantially blanketing the surface with foam. Teasing the fire is preferably accomplished by oscillating a feathered stream from left to right across, the majority of the surface of the fire, wherein one sweep or oscillation takes approximately 20 seconds. Steam from the feathered stream created at the surface of the fire takes a substantial amount of heat out of the fire and tends to blanket the surface, inhibiting access to oxygen. It has been found that when a non-feathered stream is subsequently applied to the surface of the fire a good bit of the tumultuous behavior of the burning liquid has been pacified. Preferably teasing would take place from two to four minutes. A partial flame collapse has been observed from an initial teasing alone.

Figure 9:
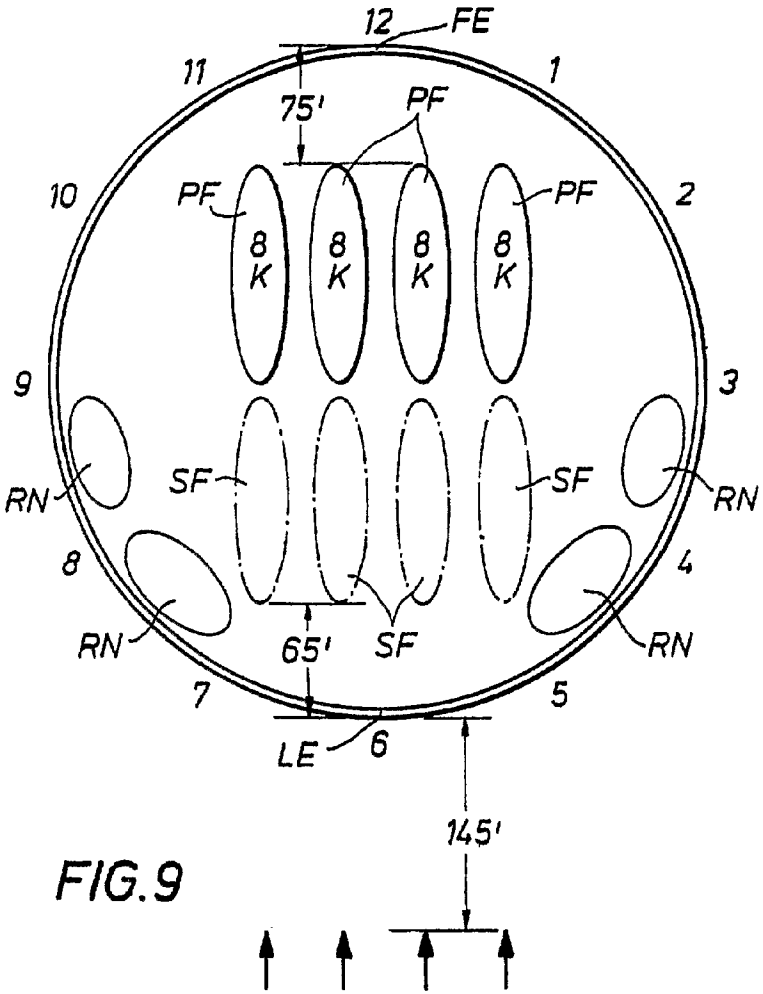
Figure 11:
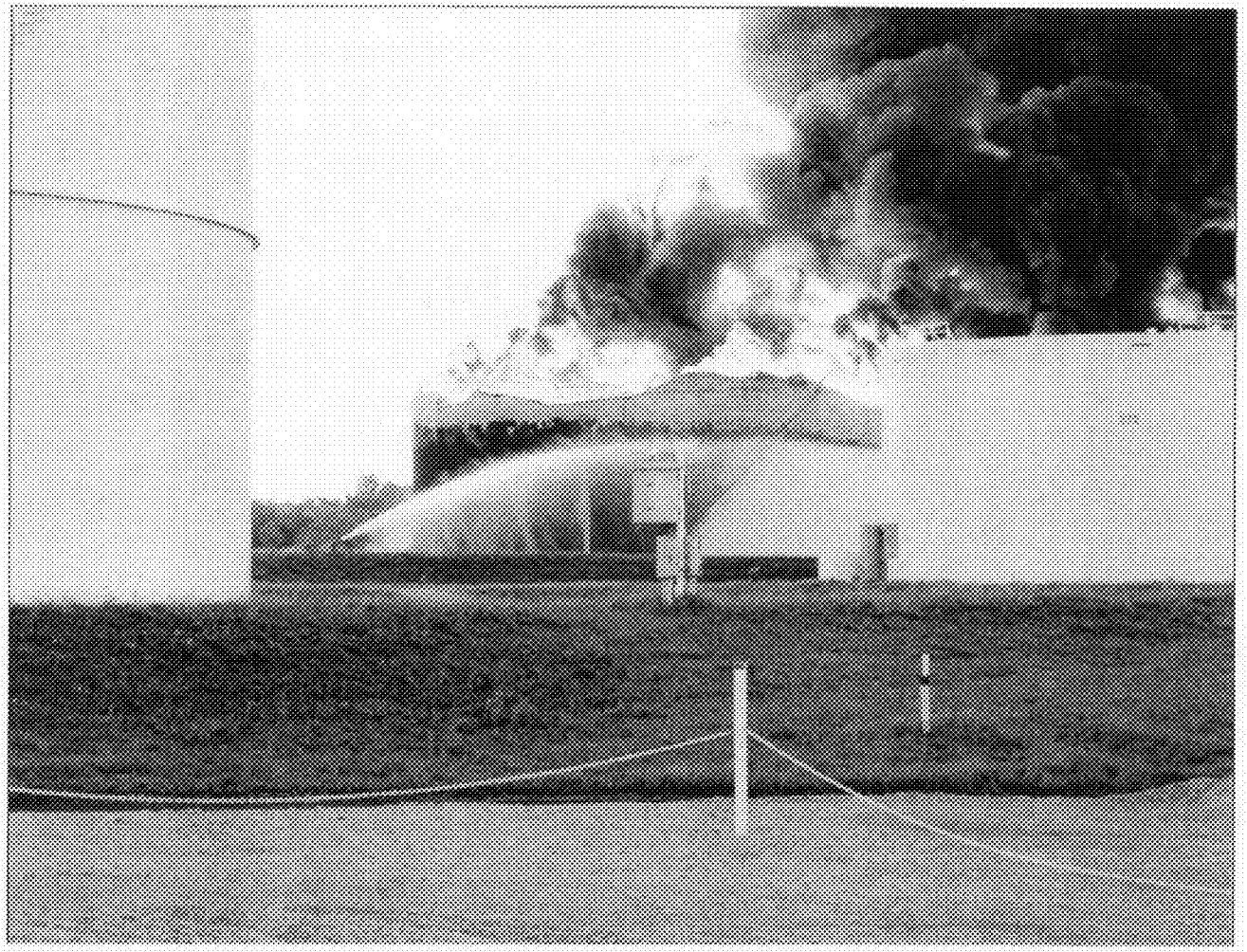
Figure 12:
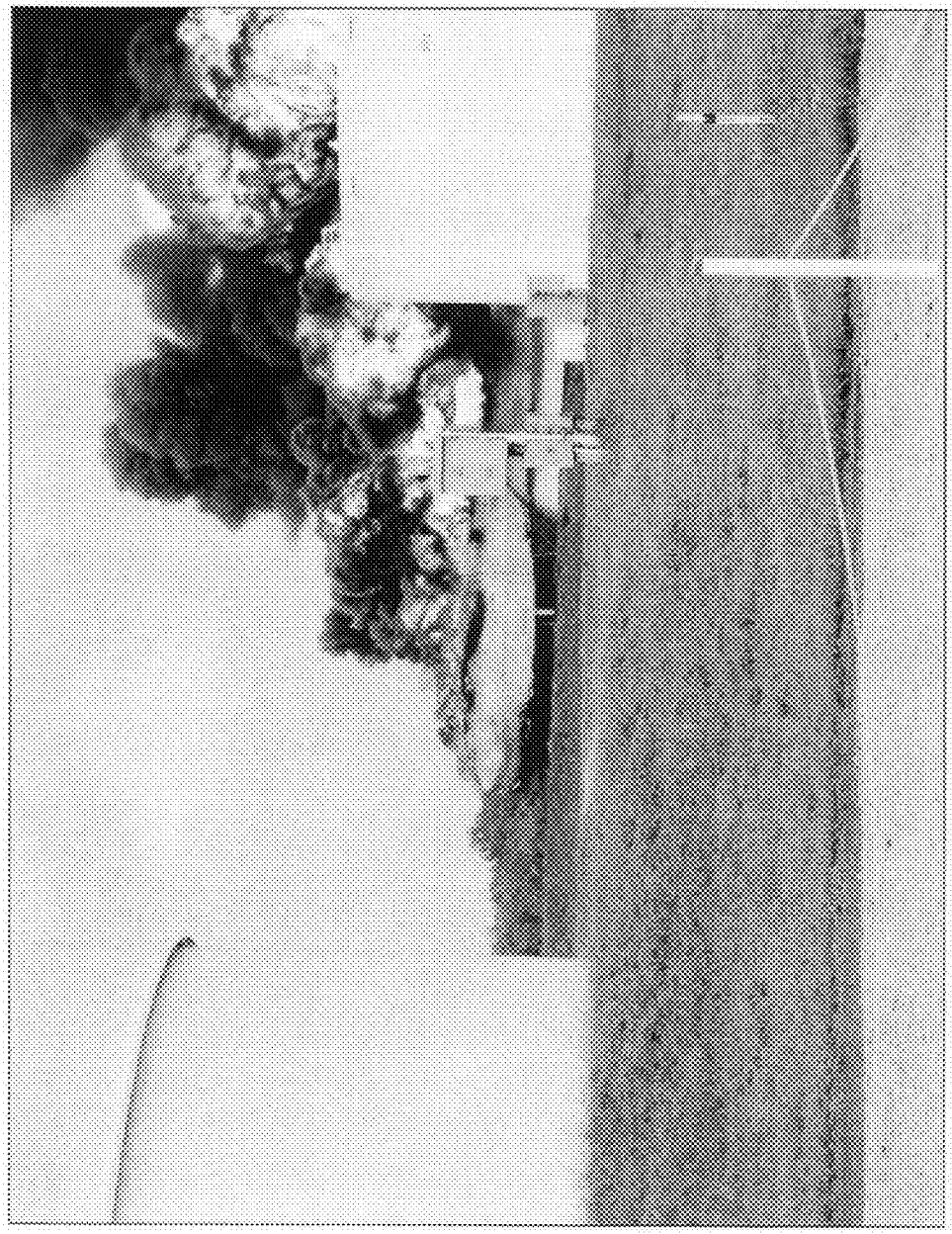
Figure 15:
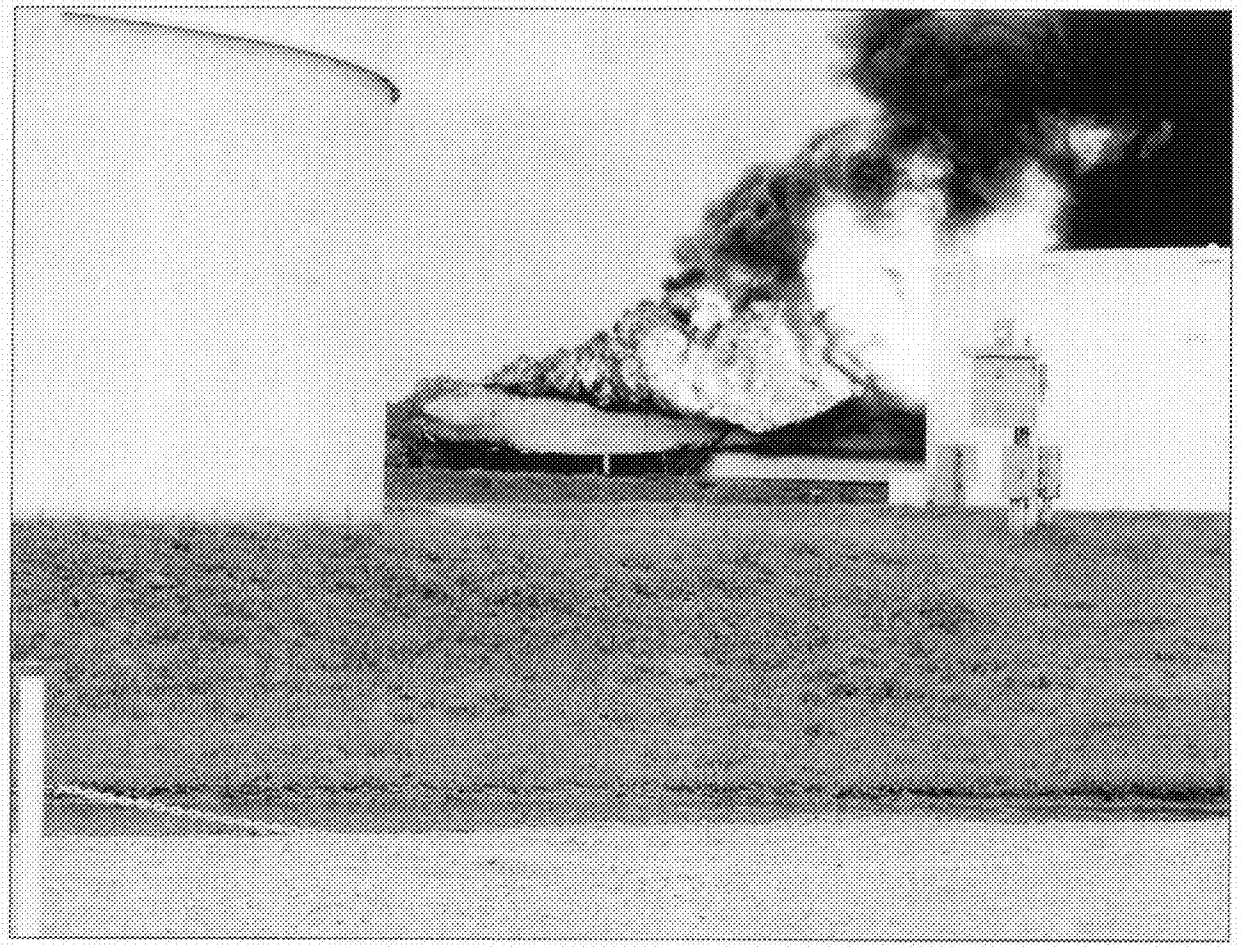
Figure 14:
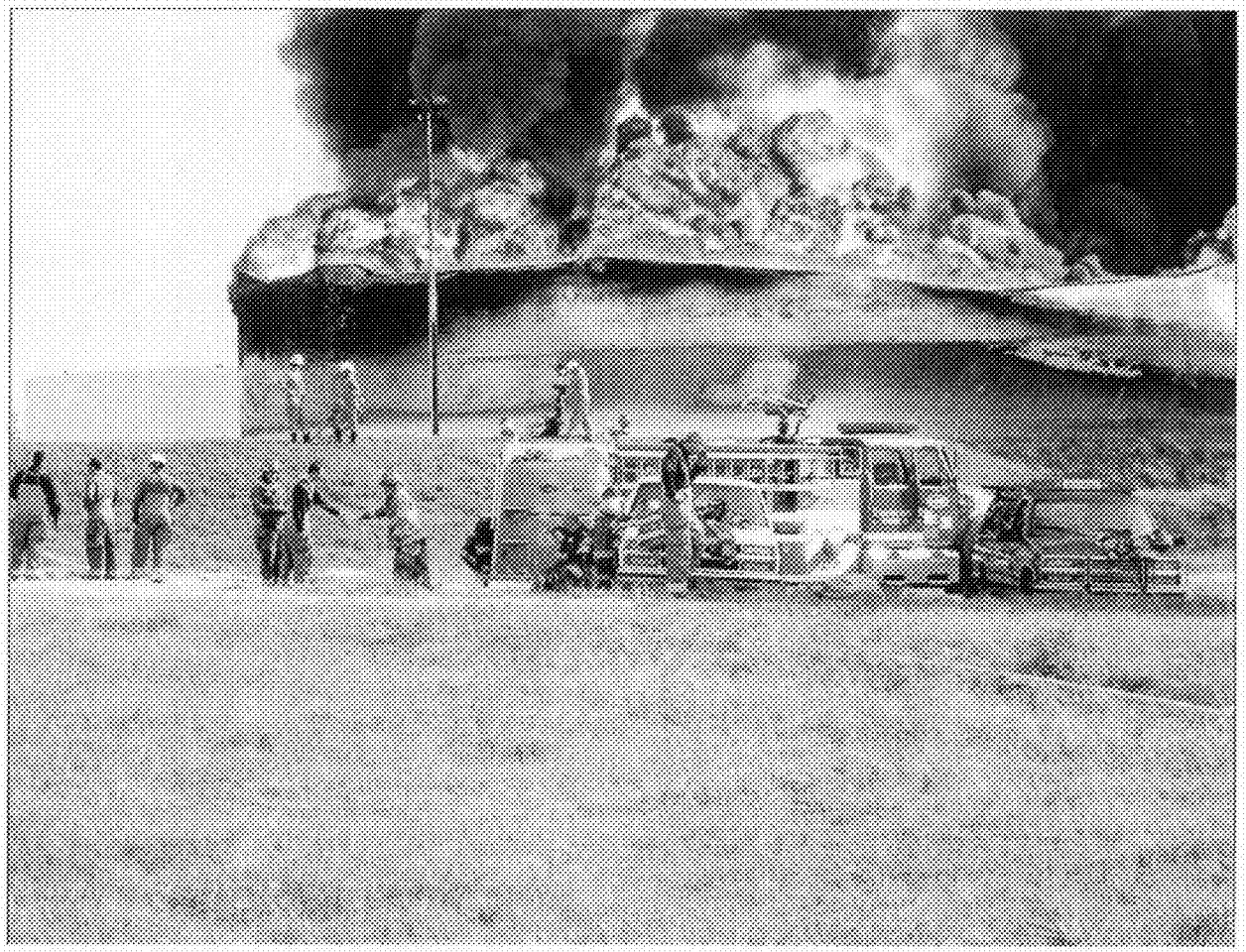
Figure 15:
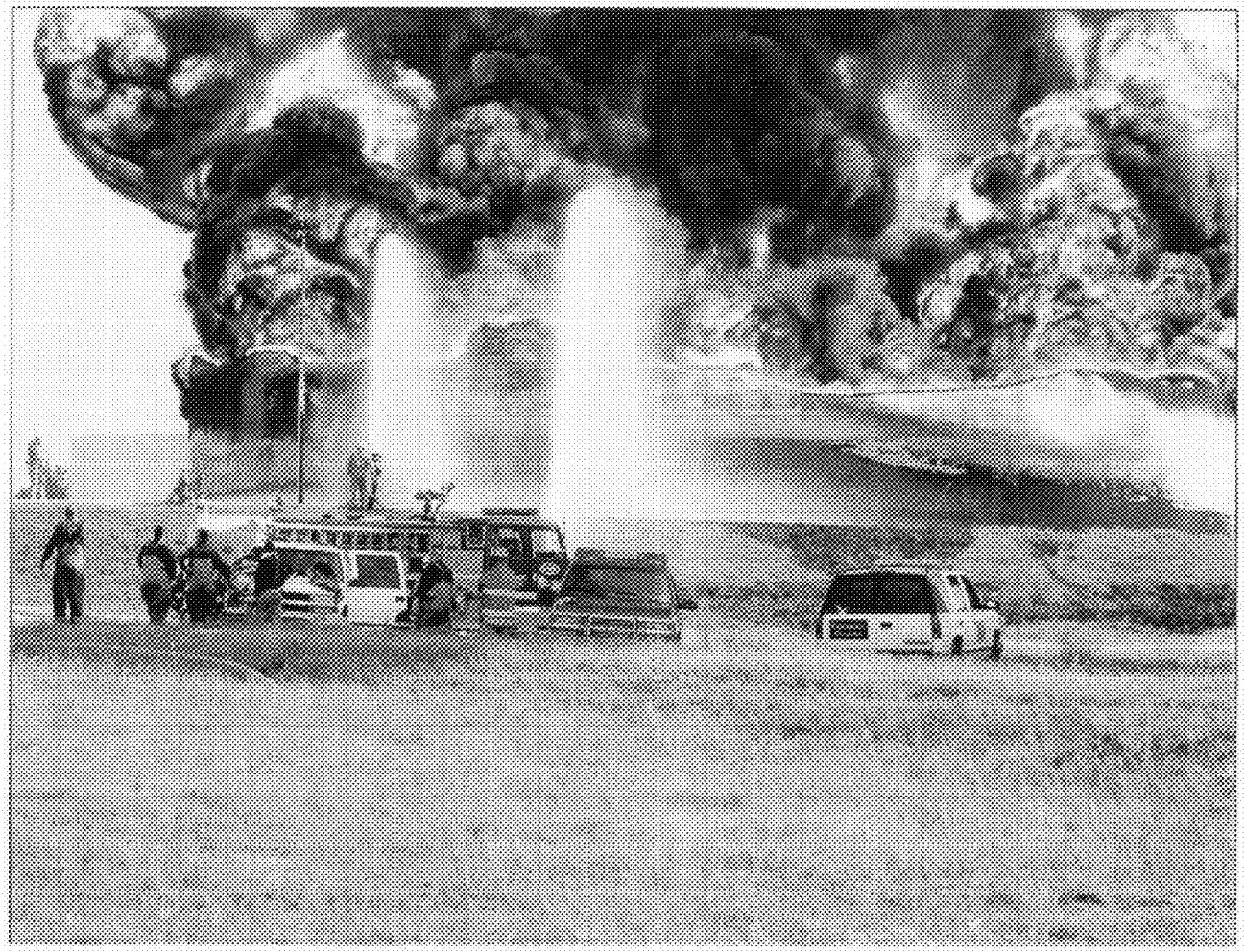
Figure 16:
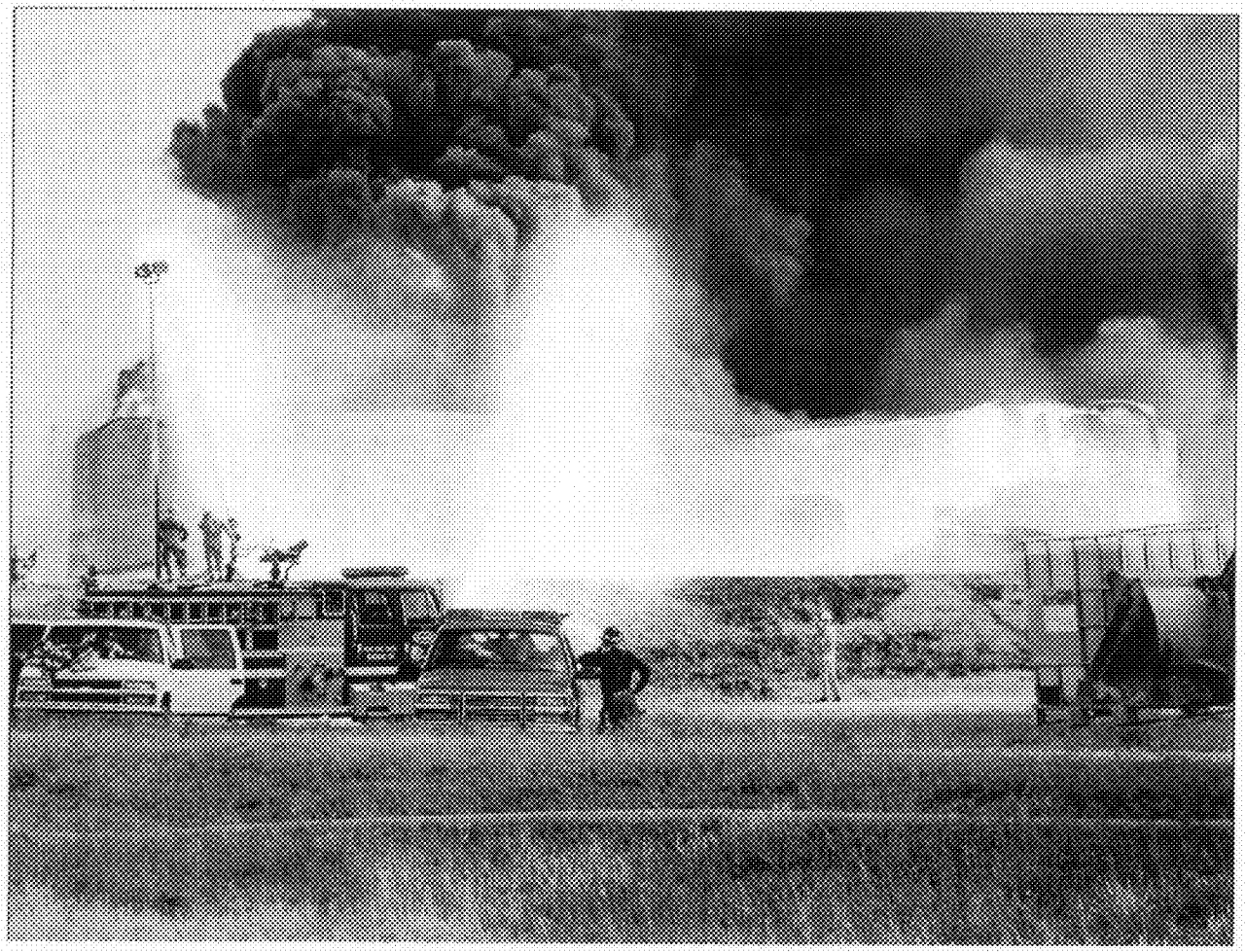

FIG. 9 illustrates computations and methodology involved in determining a secondary staging of footprints. The assumptions of FIG. 9 are a 405' diameter tank, a nozzle range of 475 feet and four 8,000 gpm primary nozzles. The far edge of the primary footprints PF from the four 8,000 gpm nozzles are staged to land approximately 75 feet (or less) from the farthest edge of back portions FE of the tank, or the 12 o'clock position. By the following computation the 8,000 gpm nozzles can be staged approximately 145 feet from the leading edge LE of the tank or the 6 o'clock position. A 405' diameter tank would have a 202.5' radius and have approximately 128,760 square feet of liquid surface area. Applying foam at an application rate of 0.25 gpm per square foot would indicate a needed application rate of 32,190 gpm in total. Four 8,000 gpm nozzles could approximately achieve that application rate. FIG. 9 further illustrates a secondary staging of the four 8,000 gpm nozzles, (preferably achieved by simply lowering their inclination angle.) Subsequent to preferably 12 to 15 minutes of primary staging of the nozzles, described above, the secondary staging lands secondary footprints SF within approximately 65 feet of the leading edge or near tank wall portions. Foam should hopefully be applied in the secondary footprint staging for approximately 12 to 15 minutes to achieve flame collapse. If a "smiley face" were created upon flame collapse, it could optimally be attacked with one or more react lines and nozzles located in the 6 to 9 o'clock and 6 to 3 o'clock positions, the react lines and nozzles directing their streams to front tank surface areas. Preferably after flame collapse in a 405' diameter tank four react lines would be located at the 9 o'clock and 7:30 and 3 o'clock and 4:30 positions. One inch react lines could supply nozzles throwing 1,500 gpm.

Figure 10:
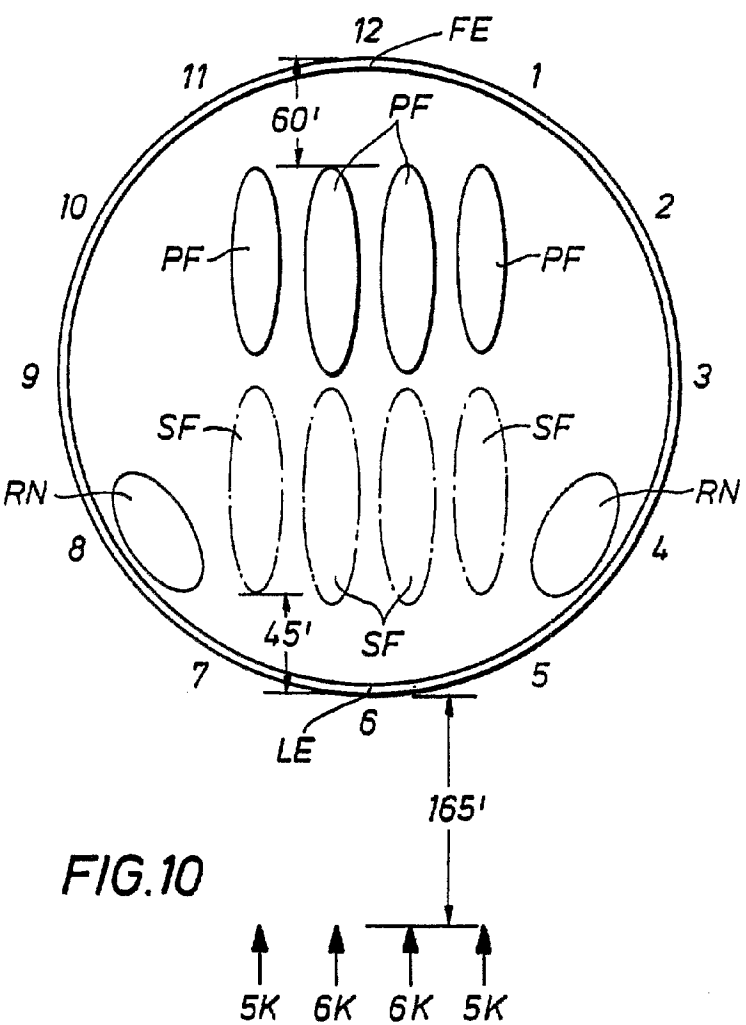
FIGS. 9 and 10 illustrate the calculations for secondary staging of footprints for a 405 foot diameter tank and a 345 foot diameter tank respectively Photos 1-13, presented as FIGS. 11-23, illustrate some problems presented by structural impediments on the surface of a liquid on fire in a tank, and some solutions thereof, illustrated by an actual event.

FIG. 10 illustrates similar calculations and methodology for 345' tank. The primary streams are shown landing in primary footprints PF within 60 feet of far tank wall portions FE. The secondary staging is shown landing secondary footprints SF within 45 feet of near tank wall portions LE. A 345' diameter tank would have a radius of 172.5 feet and approximately 93,435 square feet of surface area. At an application rate of 0.24 gpm per square foot, which is slightly below but approximately the Williams recommended gpm per square foot for this size tank reflected on Table I, this would call for throwing approximately 22,424 gallons per minute. Two 6,000 gpm nozzles and two 5,000 gpm nozzles would throw approximately 22,000 gpm and could be used. The nozzles could be staged approximately 165' away from the front tank wall portions or the 6 o'clock position by similar calculations as above, assuming that the nozzles could achieve a range of 450'. If a "smiley face" is achieved upon flame collapse, preferably two react lines staged between the 6 and 9 o'clock position and the 6 and 3 o'clock position could be employed to efficiently extinguish remaining flame in the "smiley face" area.

The secondary staging of the two 6,000 and two 5,000 gpm primary nozzles, preferably by lowering their inclination angle, is shown wherein their footprints are landed within approximately 45 feet of front tank wall portions. The two react nozzles could be 1500 gpm nozzles.

Photos 1-13 (FIGS. 11-23) illustrate aspects of embodiments of the instant invention when dealing with structural impediments to the surface of the tank. The photos were taken of a gasoline tank fire in mid July, 2006, in Glenpool, Okla. The instant inventor, together with Williams Fire & Hazard Control, extinguished the fire of gasoline tank 373. (To our knowledge, the instant inventor together with Williams Fire & Hazard Control is the only entity that has extinguished a "flammable liquid" fire in a tank of 140' diameter or greater. Others may have extinguished fires of "combustible liquids" in tanks that size. However, combustible liquids have a flashpoint of greater than 100° F. and typically have to be heated before they can burn, Combustible liquids such as diesel, thus, are much more easily extinguished, and in fact can be extinguished with water.)

The Glenpool, Okla. July, 2006 tank fire was a fire of blended gasoline, 87+ octane. The tank was 45' high with (initially) an interior floating roof and a fixed roof. The fire was ignited by lightening. The tank had approximately 43' of product. It took about 14 hours to arrive, set up the requisite equipment and supplies in order to commence an attack and for the owner to pull out about 20 feet of product off the bottom. This left about 10 feet of product in the tank. The product got too hot to pull out more.

(The heat was so great that gas and vapors were venting from the "eyebrow vents" of adjoining tanks. In fact, the nearby tanks were perilously close to combustion themselves. There was a further shortage of water.)

FIGS. 1, 2, and 3 illustrate the progress of the fire and the deterioration of the tank prior to initiation of the attack. FIG. 4 illustrates staging.

FIG. 5 shows initiation of the primary foam attack. A 2000 gpm nozzle, in the center of the picture, and a 1000 gpm nozzle, toward the left in the picture, were trained on the fire. Notwithstanding a possible visual misimpression, the two nozzles are penetrating the "updraft" of the fire and laying down their foam in tight footprints on or about the center of the burning surface of the tank. The visible "fog" about the nozzle streams represents the typical nozzle fallout. The streams are narrowly focused.

Within minutes, illustrated by FIG. 6, flame collapse (at least 50%) has been achieved. The majority of the fire has been extinguished. The 1000 gpm nozzle in FIG. 16, in fact, has shifted its footprint toward remaining fire which lies to the left in the tank. The 2000 gpm nozzle maintains the foam blanket.

Interestingly, approximately 95% of the fire was extinguished using less than three totes of foam concentrate. Almost all of a remaining fifteen totes of foam concentrate, however, were used to extinguish the remaining 5% of the fire. Such illustrates the difficulty encountered with structure impeding foam communication on a liquid surface. In uncomplicated cases, Williams hopes to achieve full flame collapse within 30 minutes.

Figure 17:
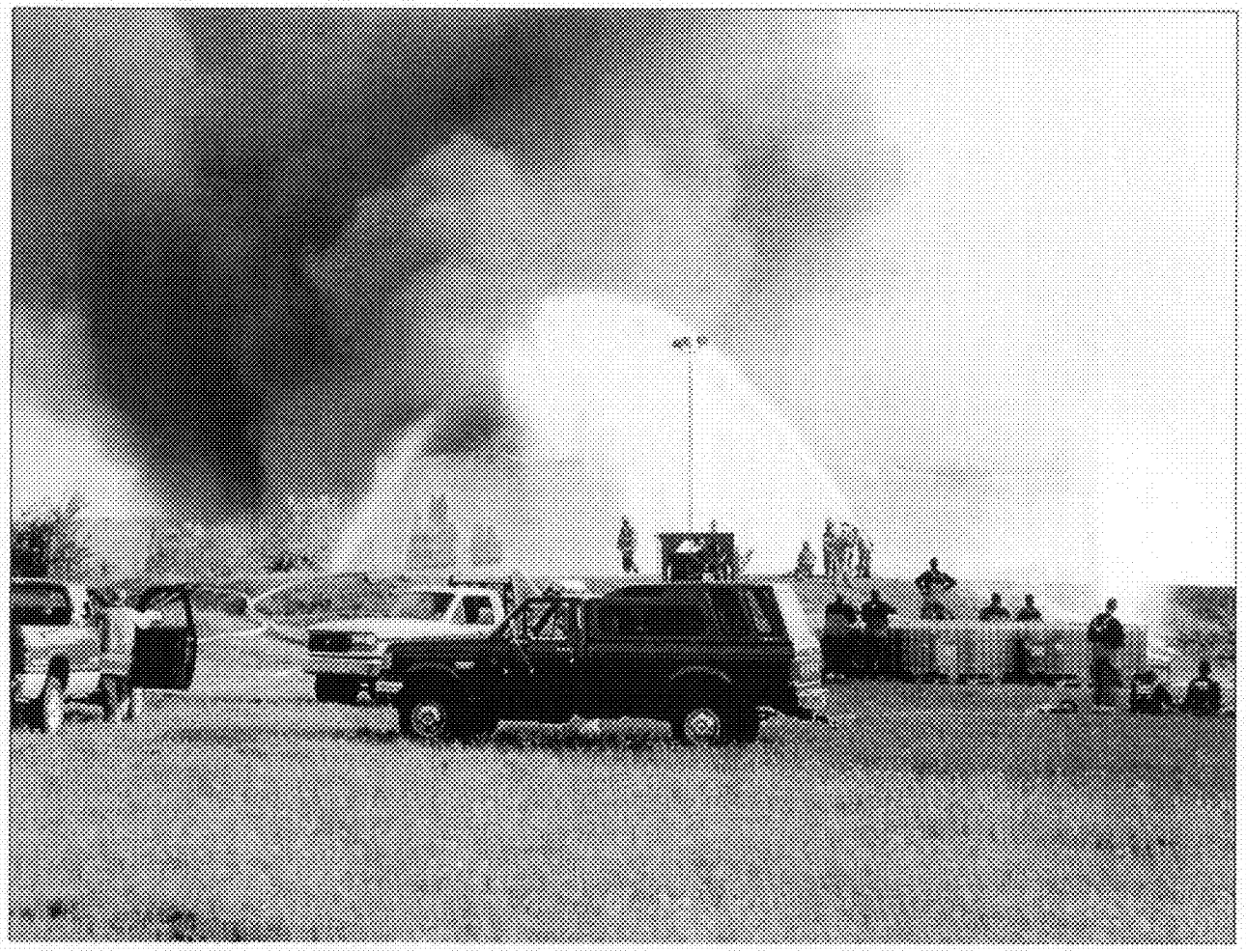
Figure 18:
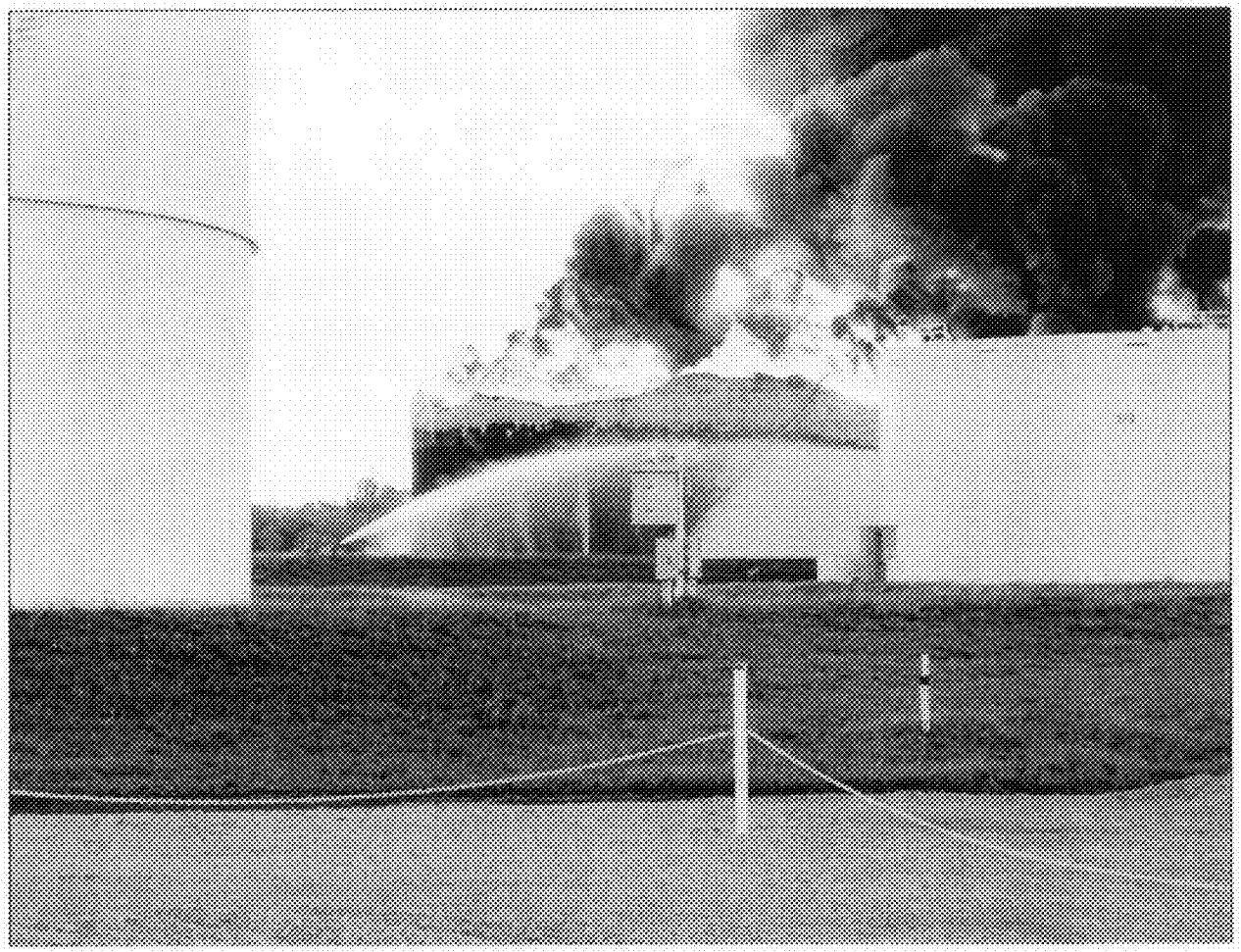
Figure 19:
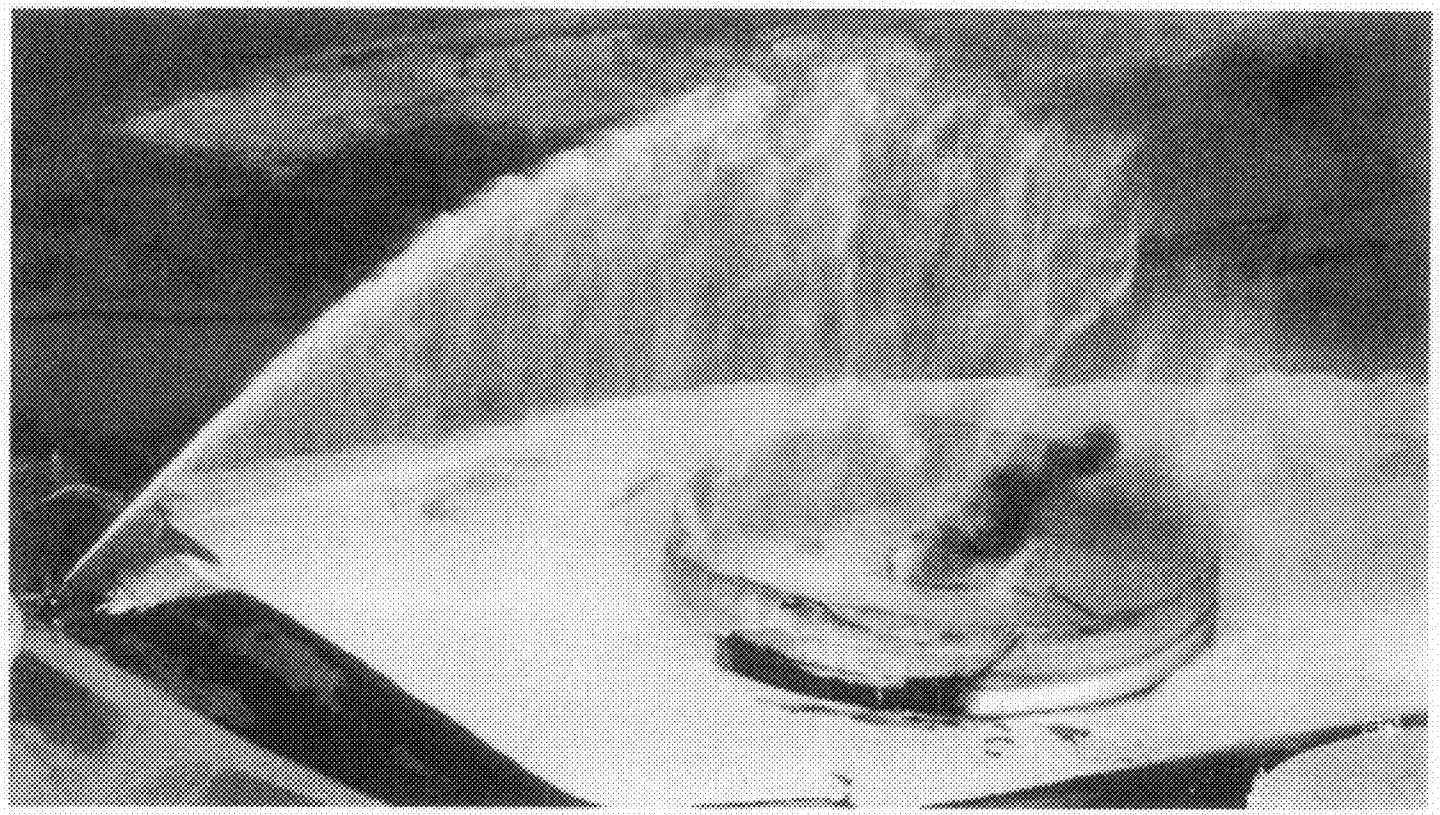

In FIG. 17 the primary nozzles have begun to be feathered. Their footprints are enlarging. Their trajectories may be oscillating. FIG. 18 illustrates the primary 2000 gpm nozzle now feathered or broadened into a rooster tail configuration. The usefulness of the rooster tail trajectory is illustrated by FIG. 19, a photo taken by helicopter, showing two remaining hot spots on the surface of the tank. These are what are referred to as "pressure-type" fires that would not be extinguished by the foam blanket. The rooster tailing effect of the 2000 gpm nozzle managed to land foam down the "chimney," so to speak, of the structures supporting these pressure-type fires. Rooster tailing also helped land foam in holes and pockets surrounded by structure. The structure was inhibiting the foam blanket from running over the full surface.

Figure 20:
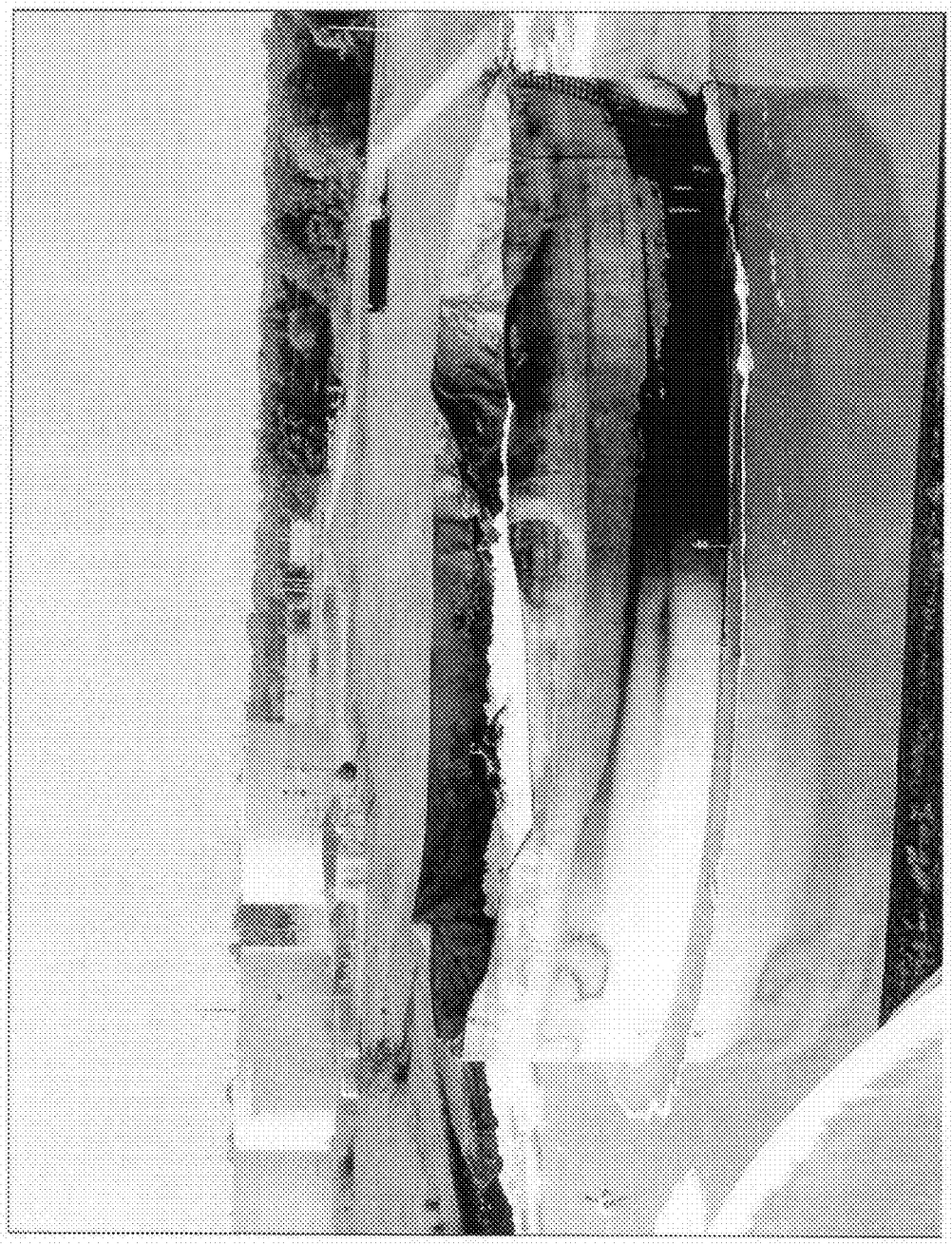

FIG. 20 illustrates the tank with the fire out. In FIG. 20 there is approximately a foot of foam lying over approximately 9 feet of product remaining in the tank, remaining that is from the 10 feet present when the attack was commenced.

Figure 21:
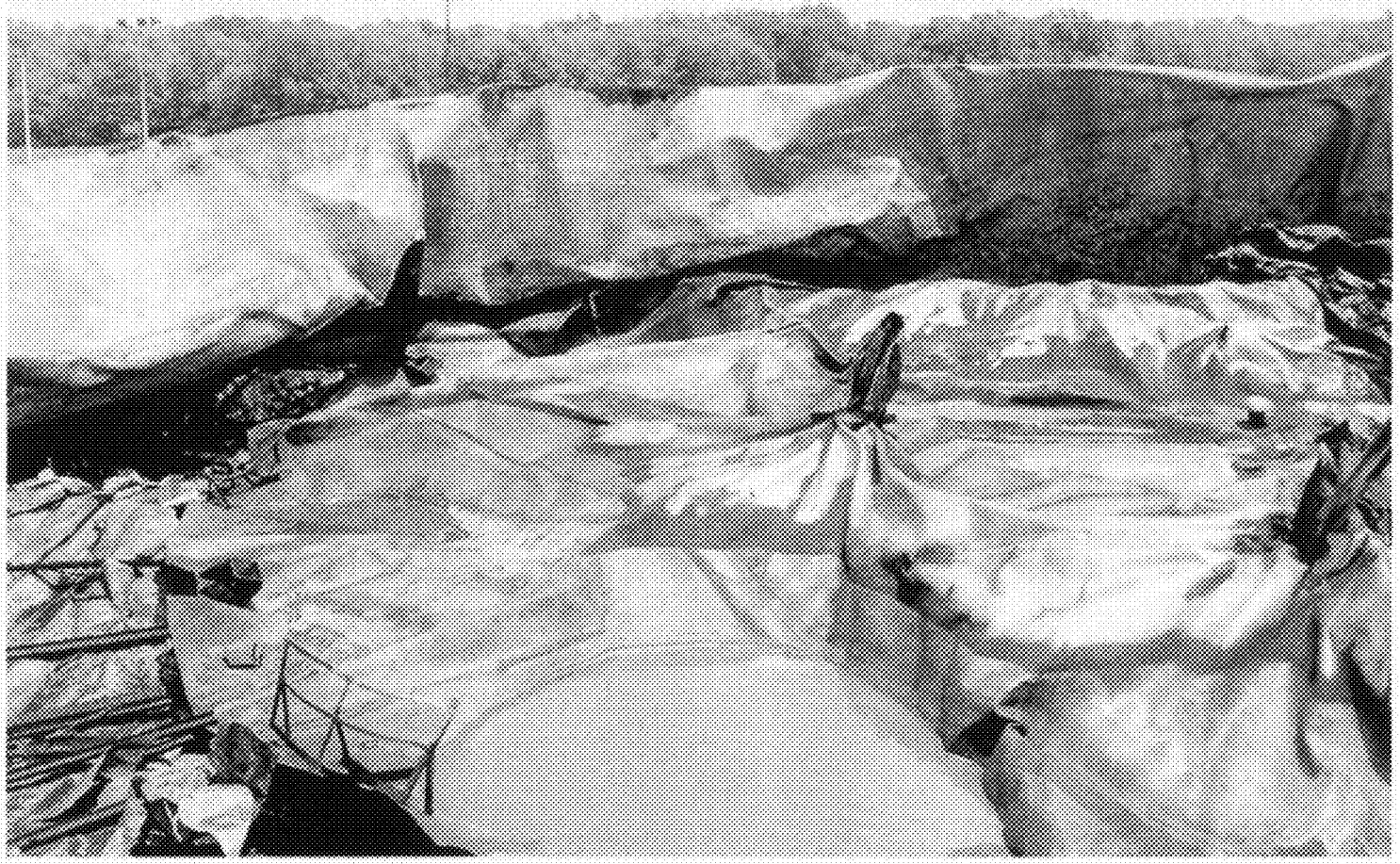
Figure 22:
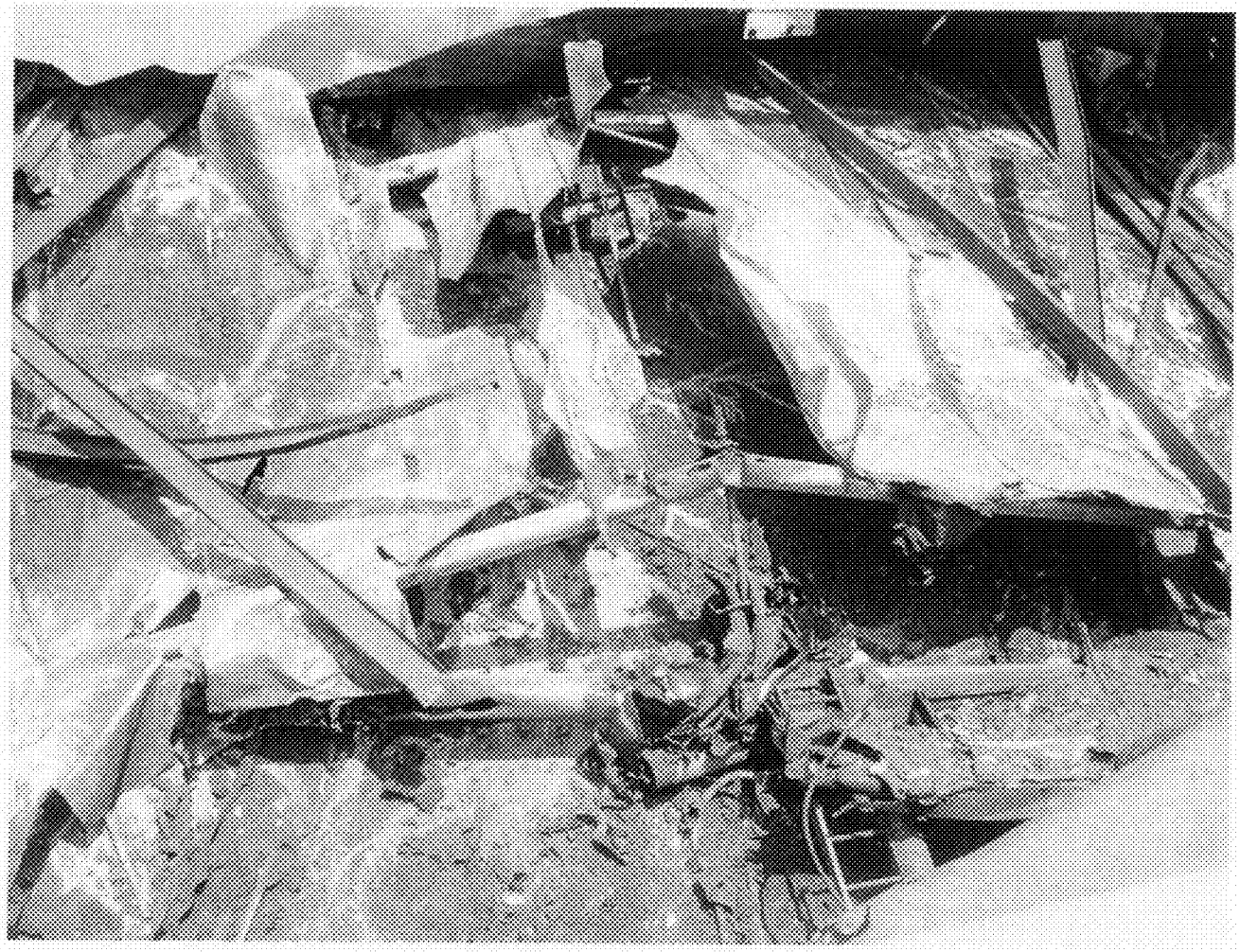
Figure 23:
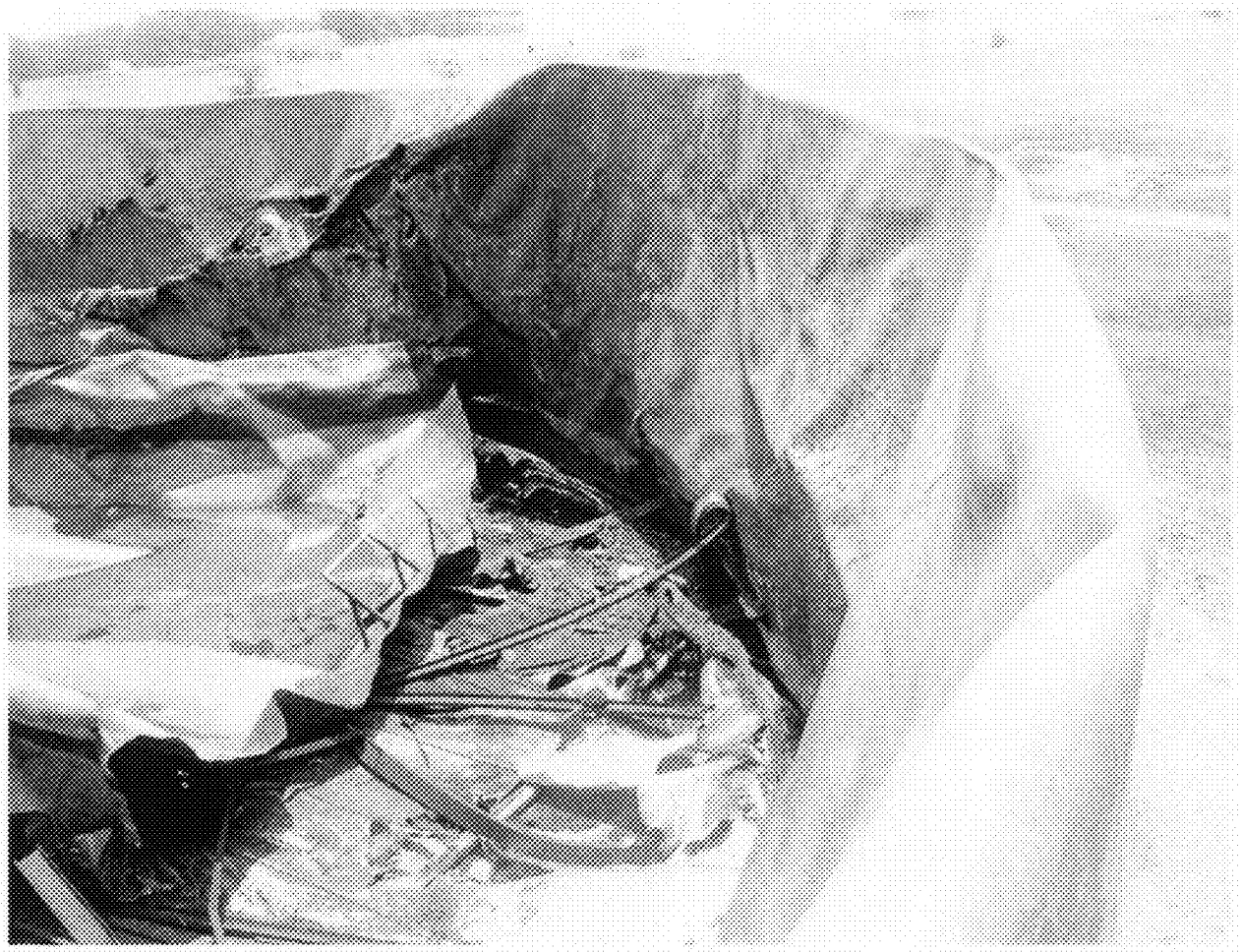

Aftermath FIGS. 21, 22 and 23, taken after the remaining product and foam has been drained off, illustrate the degree to which roof and other structures were contained within the tank.

Cost effectiveness is always a key consideration. The tank held approximately 115,000 gallons per vertical foot. At $2.00 a gallon for gasoline, the value of the product was approximately a quarter of million dollars per foot of height. The total cost of extinguishing may have run approximately a third of a million dollars, which is slightly more than the cost of a vertical foot of product in that tank.

Again, to inventor's best knowledge, Williams is the only organization that has directed the successful extinguishment of flammable liquid fires in tanks of 140' diameter or greater. To the inventor's best knowledge others that may have attempted such without Williams' consultation have had to let the product burn up, notwithstanding throwing extensive amounts of foam on or around the tank. Knowledge of proper methodology and timing is crucial.

To recap, FIGS. 9 and 10 illustrate methods for extinguishing an at least substantially full surface industrial scale hydrocarbon tank fire comprising staging primary footprints followed by staging secondary footprints. Preferably the restaging is accomplished by lowering the angle of inclination of the primary nozzles.

FIGS. 9 and 10 also illustrate timing issues in selecting the optimal methodology. After laying down a primary footprint and then a secondary footprint, a smiley face area can be attacked. Not illustrated in FIGS. 9 and 10 but illustrated in FIGS. 1-8, is the potential issue of a plunge zone fire. The timing of a plunge zone attack should be calculated and integrated into the timing of primary and secondary staging, if necessary, and attacking a smiley face, if possible.

Not illustrated by the figures, but always possible, is burning off old foam and starting over if an initial attack (as when for instance the wrong foam concentrate might have been used for the fire) has not resulted in flame collapse after at least an hour and a half of attack.

FIGS. 11 through 23 illustrate attacking and teasing a surface by applying feathered streams non-narrowly focused to remaining flames, and by rooster tailing.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

TABLE I

| Williams' Recommended Application Rates For Hydrocarbon Storage Tanks |
|---|
| Up to 150' - 0.16 GPM/Ft$^2$ |
| 151'-200' - 0.18 GPM/Ft$^2$ |
| 201'-250' - 0.20 GPM/Ft$^2$ |
| 251'-300' - 0.22 GPM/Ft$^2$ |
| 300+ - 0.25 GPM/Ft$^2$ |

TABLE II

| | Nozzle Size in GPM | | | | | | |
|---|---|---|---|---|---|---|---|
| | 2000 | 3000 | 4000 | 5000 | 6000 | 8000 | 10,000 |
| Rough Estimated Footprint Length/ Width | 90/40 | 100/ 45 | 110/50 | 115/55 | 120/60 | 130/65 | 150/70 |

What is claimed is:

1. A method for extinguishing an at least substantially full surface industrial scale hydrocarbon tank fire in a tank having a diameter greater than 300 feet, comprising:

applying an effective gpm of foam over the tank wall with one or more nozzles initially staged exterior to and generally upwind of the tank to create at least one primary landing footprint at least at or within 80% of theoretical foam run from a downwind back tank wall portion and greater than 100% of theoretical foam run from an upwind front tank wall portion, the gpm effective to establish and maintain a foam blanket; and subsequently, prior to flame collapse, restaging at least one of said one or more nozzles to create a secondary staging of nozzles such that said at least one primary landing footprint is altered to a secondary landing footprint landing at or within 75% of theoretical foam run from an upwind front tank wall portion.

2. A method for extinguishing an at least substantially full surface industrial scale hydrocarbon fire in a tank having a diameter greater than 300 feet, comprising:

applying an effective gpm of foam over the tank wall with one or more nozzles staged exterior to and generally upwind of the tank to create one or more primary landing footprints, the gpm of foam effective to establish and maintain a foam blanket and the foam landing predominantly in a downwind half of the tank; and subsequently, prior to flame collapse, restaging at least one of said one or more nozzles to create one or more secondary landing footprints at or within 75% of theoretical foam run from an upwind front tank wall portion such that a predominant portion of the gpm of foam is landed in an upwind half of the tank.

3. The method of claim 1 or 2 wherein the tank has a diameter greater than 340 feet and the restaging is performed within 15 minutes of commencing the applying and includes lowering the angle of inclination of a plurality of nozzles.

4. The method of claim 1 or 2 wherein the restaging is performed within 12 to 15 minutes of commencing the applying.

5. The method of claim 1 or 2 wherein the applying includes applying at least a gpm of foam computed from Table I.

6. The method of claim 1 or 2 that includes, (A) applying at least approximately a gpm of foam computed from Table I with one or more nozzles staged exterior to and generally upwind of the tank, creating thereby one or more footprints landing at or within 80% of theoretical foam run from a downwind back tank wall portion; and (B) subsequently, performing the steps of:

(1) restaging one or more nozzles to create a footprint more forward in the tank within at least 15 minutes of commencing of said applying; and (2) attacking a smiley face with one or more react lines within at least 30 minutes of commencing said applying.

7. The method of claim 6 wherein said restaging includes restaging within 12 to 15 minutes of commencing said applying.

8. The method of claim 6 wherein said attacking a smiley face includes attacking within at least 25 minutes of commencing said applying.

9. The method of claim 1 or 2 wherein the restaging to create a secondary staging includes restaging exterior to and generally upwind of the tank.

10. The method of claim 1 or 2 wherein the applying and restaging includes the landing footprint(s) of the initially staged nozzle(s) and of the secondarily staged nozzle(s) being neither, by themselves, predicted to land and run foam to blanket the tank with foam.

11. A method for extinguishing an at least substantially full surface industrial scale hydrocarbon fire in a tank having a diameter greater than 300 feet, comprising:

applying an effective gpm of foam over the tank wall with one or more nozzles initially staged exterior to and generally upwind of the tank to create at least one primary landing footprint at least at or within 80% of theoretical foam run from a tangent drawn to a back tank wall downwind 12 o'clock position and greater than 100% of theoretical foam run from a tangent drawn to a front tank wall upwind 6 o'clock position, the gpm effective to establish and maintain a foam blanket; and subsequently, prior to flame collapse, restaging at least one of said one or more nozzles to create a secondary staging of nozzles such that said at least one primary landing footprint is altered to a secondary landing footprint landing at or within 75% of theoretical foam run from a tangent drawn to the front tank wall upwind 6 o'clock position.

12. The method of claims 1, 2 or 11 wherein theoretical foam run is 100 feet.

* * * * *